US008179287B2

(12) United States Patent
Kato et al.

(10) Patent No.: US 8,179,287 B2
(45) Date of Patent: May 15, 2012

(54) METHOD AND APPARATUS FOR COMMUNICATING MAP AND ROUTE GUIDANCE INFORMATION FOR VEHICLE NAVIGATION

(75) Inventors: Manabu Kato, Hitachi (JP); Shigeru Matsuo, Hitachinaka (JP); Mariko Okude, Hitachi (JP); Yukihiro Kawamata, Hitachi (JP); Yoshitaka Atarashi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 1084 days.

(21) Appl. No.: 11/969,454

(22) Filed: Jan. 4, 2008

(65) Prior Publication Data

US 2008/0103693 A1 May 1, 2008

Related U.S. Application Data

(63) Continuation of application No. 10/959,316, filed on Oct. 7, 2004, now Pat. No. 7,342,516.

(30) Foreign Application Priority Data

Oct. 8, 2003 (JP) ..... 2003-349023
Mar. 1, 2004 (JP) ..... 2004-055638

(51) Int. Cl.
*G08G 1/123* (2006.01)

(52) U.S. Cl. ..... 340/995.15; 340/539.13; 340/539.2; 340/995.17; 340/995.19; 701/201; 701/209; 701/212

(58) Field of Classification Search ..... 340/995.1, 340/995.11–995.23; 701/208–212
See application file for complete search history.

(56) References Cited

U.S. PATENT DOCUMENTS

| | | | | |
|---|---|---|---|---|
| 7,342,516 | B2 * | 3/2008 | Kato et al. | 340/995.19 |
| 7,660,667 | B2 * | 2/2010 | Furukawa | 701/212 |
| 7,818,116 | B1 * | 10/2010 | Nesbitt | 701/201 |
| 2002/0042674 | A1 * | 4/2002 | Mochizuki et al. | 701/211 |
| 2002/0128768 | A1 * | 9/2002 | Nakano et al. | 701/202 |
| 2003/0229444 | A1 * | 12/2003 | Bullock et al. | 701/202 |

OTHER PUBLICATIONS 1 sheet of Form PTO-892 and 2 sheets of Form PTO-1449 from parent application.

* cited by examiner

*Primary Examiner* — Brent Swarthout
(74) *Attorney, Agent, or Firm* — Crowell & Moring LLP

(57) ABSTRACT

A route information supply system comprises a reception module which receives information on a current position and a destination from a terminal device by communication, a map data storage module storing at least detailed map data and summary map data, a traffic information storage module which stores traffic information, a route search module which searches for a guidance route based on the current position and the destination, a map information generation module which generates map information on an area containing the searched route by use of the map data storage module, and an output module which outputs the generated map information to the terminal device. When an event satisfying a prescribed condition regarding the traffic information exists in the area, the map information generation module generates map information on an area in the vicinity of a point where the event has occurred by use of the detailed map data.

3 Claims, 21 Drawing Sheets

METHOD AND APPARATUS FOR COMMUNICATING MAP AND ROUTE GUIDANCE INFORMATION FOR VEHICLE NAVIGATION

This application is a continuation of U.S. patent application Ser. No. 10/959,316, filed Oct. 7, 2004, now U.S. Pat. No. 7,342,516, the entire disclosure of which is incorporated herein by reference, which in turn claims priority under 35 U.S.C. §119 of prior Japanese application nos. 2003-349023, filed Oct. 8, 2003 and 2004-055638, filed Mar. 1, 2004.

BACKGROUND OF THE INVENTION

The present invention relates to a route information supply system, and in particular, to a server device supplying route information, a map display device communicating positional information and the route information with the server device, and a route information supply system supplying map information taking traffic information into consideration.

Conventional navigation systems installed in a mobile unit (vehicle, etc.) are equipped with a storage medium (CD-ROM, DVD-ROM, etc.) storing map information and provide route guidance to a driver, etc. by reading necessary map data from the storage medium. In recent years, communicating navigation systems are being proposed instead of such navigation systems, in which map information is prestored in a server device which is placed outside the mobile unit and a terminal device installed in the mobile unit obtains the map information by communicating with the server device and thereby provides route guidance.

Regarding such communicating navigation systems, techniques for acquiring a detailed map of a particular region (e.g. destination) from the server device as needed are well known. However, even if such a detailed map of the destination can be obtained, memory usage efficiency gets worse when the distance from the destination is long. To avoid the problem, techniques capable of acquiring detailed maps with proper timing have been proposed.

For example, in a technique disclosed in JP-A-11-38872, traffic information is collected and when the mobile unit approaches a construction site, a traffic jam, etc., a detailed map of the point of construction, traffic jam, etc. is acquired and a route which has already been set is altered using the detailed map.

As for the delivery of maps, a technique for reducing the mount of map data has been disclosed in JP-A-2001-84493, in which a map of a limited area (within a prescribed distance from the route or within a preset number of intersections from the route) is cut out and delivered, leaving out map information on distant areas which are not directly relevant to the route guidance, by which the amount of map data is reduced. According to the technique, in the case where a cut-out width for cutting out a zonal map along the route is designated by the distance, setting a large width causes an increase in the amount of map data (including map information not directly relevant to the route guidance). On the other hand, if the cut-out width is set small, relevant intersections might not be included in the map which is cut out. In the case where the cut-out width is designated as an area within a prescribed number of intersections from the route, the width of the zonal map changes sharply in areas having large variations in the interval between intersections, by which areas with no map might be displayed on the screen when the terminal is displaying an area in the vicinity of an intersection corresponding to a narrow width of the zonal map. To avoid displaying such areas with no map, it is possible to adjust the display scale depending on the width; however, the display scale after the adjustment might not suit the user's intention. Meanwhile, in a method being studied, maps are cut out gradually dropping their finenesses as the distance from the route increases. For example, information on an area nearby the route can be certainly notified to the driver while cutting down the amount of map data, by partitioning an area for a route vicinity map into a plurality of areas based on the distance from the route, generating the route vicinity map by cutting out maps of areas in the vicinity of the route as detailed maps while cutting out maps of areas distant from the route as extensive maps, and delivering the generated route vicinity map.

However, in the above technique, even if traffic information is gathered and delivered to the mobile unit together with the map, the information is not used until the mobile unit approaches a construction site, traffic jam, etc. Therefore, even when a construction site, traffic jam, etc. exists on the route or nearby the route, the fact is not previously known at the stage of the route search, by which options for avoiding the traffic jam, etc. are necessitated to be limited.

Further, when the map delivered is displayed, the way of processing map elements existing on a boundary line between map areas having different finenesses becomes a problem. Specifically, if such map elements are partitioned at the boundary line into configurations having different finenesses, problems like unconformity of road joining points, discontinuity of background configurations, redundancy of name display, etc. are caused. Such reduction of the information amount by changing the fineness of map areas distant from the route can surely decrease the amount of map data; however, the aforementioned irregularities of configuration occurs to the map elements existing on the area boundary and thereby visibility of the map is deteriorated.

It is therefore the primary object of the present invention to realize map display taking traffic information into consideration in the route search carried out by a communicating route information supply system.

Another object of the present invention is to provide a map display system capable of maintaining visibility of map display even when the amount of data of the route vicinity map is reduced.

SUMMARY OF THE INVENTION

In order to resolve the above problems, in the present invention, traffic information is referred to in the route search and when an event satisfying a prescribed condition has occurred, detailed map display is carried out for an area in the vicinity of a point where the event has occurred.

In accordance with an aspect of the present invention, there is provided a route information supply system comprising reception means which receives information on a current position and a destination from a terminal device by communication, map data storage means storing at least detailed map data and summary map data, traffic information storage means which stores traffic information, route search means which searches for a guidance route based on the current position and the destination, map information generation means which generates map information on an area containing the route found by the search by use of the map data storage means, and output means which outputs the generated map information to the terminal device. In the route information supply system, when an event satisfying a prescribed condition regarding the traffic information exists in the area, the map information generation means generates map information on an area in the vicinity of a point where the event has occurred by use of the detailed map data.

To attain the above objects, in accordance with another aspect of the present invention, in a map display system comprising a server device (including a route search module which searches for a route to a destination, a map generation module which generates a route vicinity map containing the route, map modification means which modifies the route vicinity map generated by the map generation module, and a map database which is referred to when the route vicinity map is generated) and a client device (including a communication module which communicates with the server device, a vehicle position locating module which locates the position of a vehicle, and a display module which displays the route vicinity map), the map generation module generates the route vicinity map by setting map areas having different finenesses based on the distance from the route, and the map modification means modifies configurations of map elements intersecting with a boundary line between the map areas.

As described above, by the present invention, map display taking traffic information into consideration can be realized in the route search in a communicating route information supply system.

Further, the amount of map data can be reduce efficiently while maintaining visibility of the map.

The objects and features of the present invention will become more apparent from the consideration of the following detailed description taken in conjunction with the accompanying drawings.

DESCRIPTION OF THE EMBODIMENTS

Figure 1:
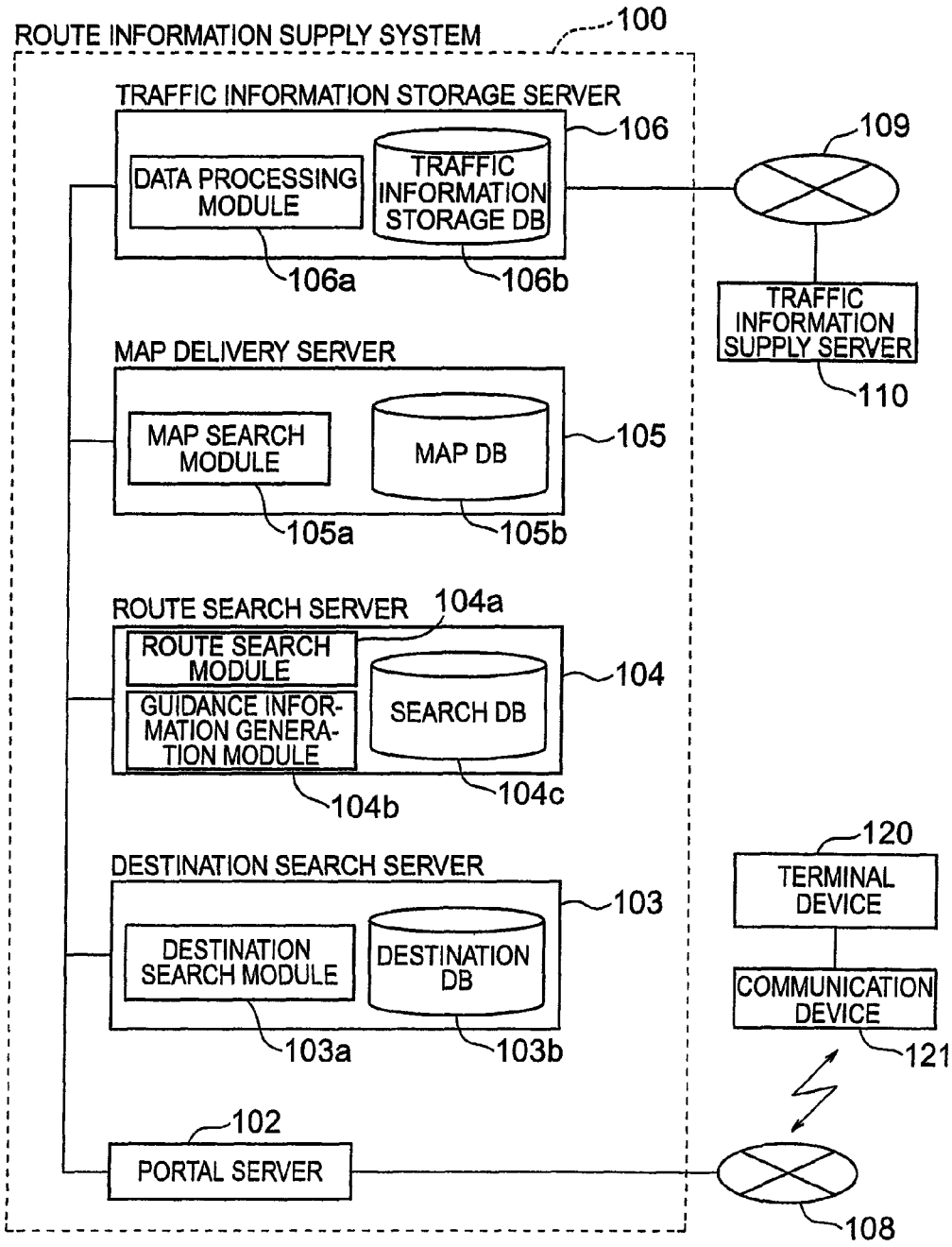
FIG. 1 is a block diagram showing the overall composition of a communicating navigation system.

Referring now to the drawings, a description will be given in detail of preferred embodiments in accordance with the present invention.

FIG. 1 is a block diagram showing the overall composition of a communicating navigation system which includes a route information supply system 100 in accordance with the present invention, a traffic information supply server 110 for supplying traffic information, and a terminal device 120 which is supplied with route information from the route information supply system 100.

As shown in FIG. 1, the route information supply system 100 is formed by a server group including a plurality of server devices 102-106 which are connected together. The server devices are provided to the route information supply system 100 for implementing separate functions. For example, the server group can include a portal server 102 which controls the operation of the server group and the communication with the terminal device 120, a destination search server 103 which executes a process for setting the destination, a route search server 104 which searches for a route from the current position to the destination and thereby generates guidance information, a map delivery server 105 which generates map information to be delivered to the terminal device 120, and a traffic information storage server 106 which stores the traffic information. The composition of the route information supply system 100 is not restricted to this particular example. For instance, the route information supply system 100 may also be formed by only one server device.

The terminal device 120 is capable of communicating with the portal server 102 of the route information supply system 100 in cooperation with a communication device 121 (cellular phone, etc.) having a communication function. In this case, a cellular phone network 108 can be used as the transmission medium. The terminal device 120 may also be equipped with the communication function so as to communicate with the portal server 102 independently.

The terminal device 120 can be implemented by a general-purpose information processing device of a portable type which includes a controller, a display device (liquid crystal display, etc.), a storage unit, etc. However, a position locating function, typified by the GPS (Global Positioning System), is provided to the terminal device 120 internally or externally. The terminal device 120 my also be implemented by a special-purpose device developed for particular application (for vehicles, etc.).

The terminal device 120 and the communication device 121 are mounted on a mobile unit such as a car, a motorcycle, etc. The devices 120 and 121 may also be carried by a pedestrian.

Next, the aforementioned server devices 102-106 forming the route information supply system 100 will be explained below. Each server device 102-106 can be implemented by a general-purpose information processing device (server computer, etc.) which includes a processor, an I/O (Input/Output) unit, a storage unit, etc.

The portal server 102 controls each server device of the route information supply system 100 (specifically, requesting processes, receiving results of the processes, etc.) and communicates with the terminal device 120 as mentioned above. Concrete processes executed by the portal server 102 will be described in detail later.

The destination search server 103 includes a destination search module 103*a* and a destination DB 103*b*. When a search condition for searching for the destination is received, the destination search server 103 searches for destinations that matches the condition and outputs the searched destinations. In other words, the destination search server 103 supports the user who is setting the destination in a route search.

The destination DB 103*b* is a database storing information to be used when the destination as the target of the route search is set. Specifically, the destination DB 103*b* stores the name, address, phone number, positional information (latitude, longitude, etc.), type of facility, category information (classified by purpose), etc., for each place, facility, etc. that can be a destination.

When any of the above information is received as the search condition, the destination search module 103*a* extracts the name, address, positional information (latitude, longitude, etc.), etc. of each record containing the information as search results. As the search condition, a combination of an address and a type of facility, etc. can be used, or the user may designate a point and a purpose so that facilities existing within a prescribed range of the designated point and being classified into the designated purpose will be extracted as the search results. In short, by inputting some information on the destination which has been stored in the destination DB 103*b*, the user can obtain destination candidate information regarding facilities or places that are related to the inputted information.

The route search server 104, including a route search module 104*a*, a guidance information generation module 104*b* and a search DB 104*c*, receives positional information on the start point and the destination point (together with route search conditions and traffic information as needed), searches for a route to be recommended, and outputs the recommended route.

The search DB 104*c* is a database storing node data, link data, link cost data, passage condition data, etc. which form road configuration network data necessary for the route search. Data that are used in conventional navigation systems can be used as these data.

The route search module 104*a* refers to the search DB 104*c* and thereby figures out route data of an optimum route connecting the start point and the destination point, according to a well known algorithm such as the Dijkstra algorithm for the start point and the destination point. In the route search process, the route search conditions, traffic information, etc. are taken into consideration as needed.

The route data obtained by the route search module 104*a* includes a route ID, link IDs, road types, traveling directions and link travel times, (and reference information to be used for referring to guidance information storage data in cases where a link includes an intersection where guidance should be given), for example.

The guidance information generation module 104*b* generates the guidance information for the obtained route data by referring to the search DB 104*c*. The guidance information includes link direction, intersection type, intersection name, entering link names, exiting link names, necessary time, landmark names and lane information regarding each intersection where the guidance should be given, for example. The guidance information can also be generated by conventional techniques.

The map delivery server 105, including a map search module 105*a* and a map DP 105*b*, generates map information based on the result of the route search, etc.

The map DP 105*b* is a database storing map data to be used for displaying the map information. The map data are managed in the map DP 105*b* in units of meshes which are formed by systematically partitioning the whole map.

The map data includes road data, background data and name data. The road data is composed of data such as link sequence IDs, road type codes, road names, link IDs, mesh IDs and coordinate value sequences. The background data is composed of background element IDs, background type codes, reference IDs to be used for referring to a name data table, coordinate value sequences, mesh IDs, etc. The name data is composed of name element IDs, name type codes, name reference IDs, character strings, character string directions, coordinate values, mesh IDs, etc.

Incidentally, a level number (map level) is assigned to each map data depending on its fineness of information. The road data, the background data and the name data are stored in the map DP 105*b* being classified for each map level. A map level 1 will hereinafter be assumed to contain the most detailed information. The information gets coarser as the level number increases as level 2, level 3, and so forth.

The map search module 105*a* carries out a point sequence conversion process and a map search process.

The point sequence conversion process is a process for obtaining a coordinate value sequence of the route based on a link ID sequence which represents the route between the start point and the end point in the route data obtained by the route search server 104. Specifically, records are extracted from the map DP 105*b* for each link in the link ID sequence of the route and thereby coordinate value sequence data for the route corresponding to the link ID sequence are obtained.

The map search process is a process for generating map information on an area containing the route data based on the map data (road data, background data and name data) stored in the map DP 105*b*. The usage of map data of each map level for each range varies among the embodiments, therefore, the usage of map levels will be explained later in each of the following embodiments.

The traffic information storage server 106 includes a data processing module 106*a* and a traffic information storage DB 106*b*. The traffic information storage server 106 is connected to the traffic information supply server 110 via an IP network 109.

The traffic information supply server 110 is a server which is generally in practical use today as the VICS (Vehicle Information Communication System), which supplies traffic information (congestion information, regulation information, accident information, etc.) via an FM network, IP network, etc. The traffic information provided by the traffic information supply server 110 includes, for example, an event ID, event type (indicating whether the event is an accident, natural congestion, road construction, etc.), road name, location ID (for identifying the position), occurrence time, expected end time, travel time, etc.

The traffic information storage DB 106*b* is a database for storing data based on the traffic information received from the traffic information supply server 110.

The data processing module 106*a* of the traffic information storage server 106 processes traffic information data which are supplied from the traffic information supply server 110 and stores the processed data in the traffic information storage DB 106*b*. The processing is executed mainly for converting a location ID used by the traffic information supply server into positional information, etc. used by the route information supply system 100. The processing can be carried out by the following procedure, for example. First, the location ID which is used by the traffic information supply server is converted into a link ID which is used by the map DP 105*b* and the search DB 104*c* by use of a prepared conversion table, for example. Meanwhile, the degree of significance of the traffic event is figured out from the travel time or the expected end time. The significance degree of the traffic event can be obtained by, for example, classifying the travel time or expected end time into a level using prescribed threshold values. The travel time or expected end time for determining the significance degree of traffic event may either be the data supplied from the traffic information supply server 110 or data figured out using past traffic information accumulated in the traffic information storage server 106 by means of statistical techniques, etc. Subsequently, coordinates of the point where the event has occurred is obtained from the link ID. This step can be carried out similarly to the point sequence conversion process executed by the map delivery server 105. Further, a link cost is figured out from the travel time.

Figure 2:
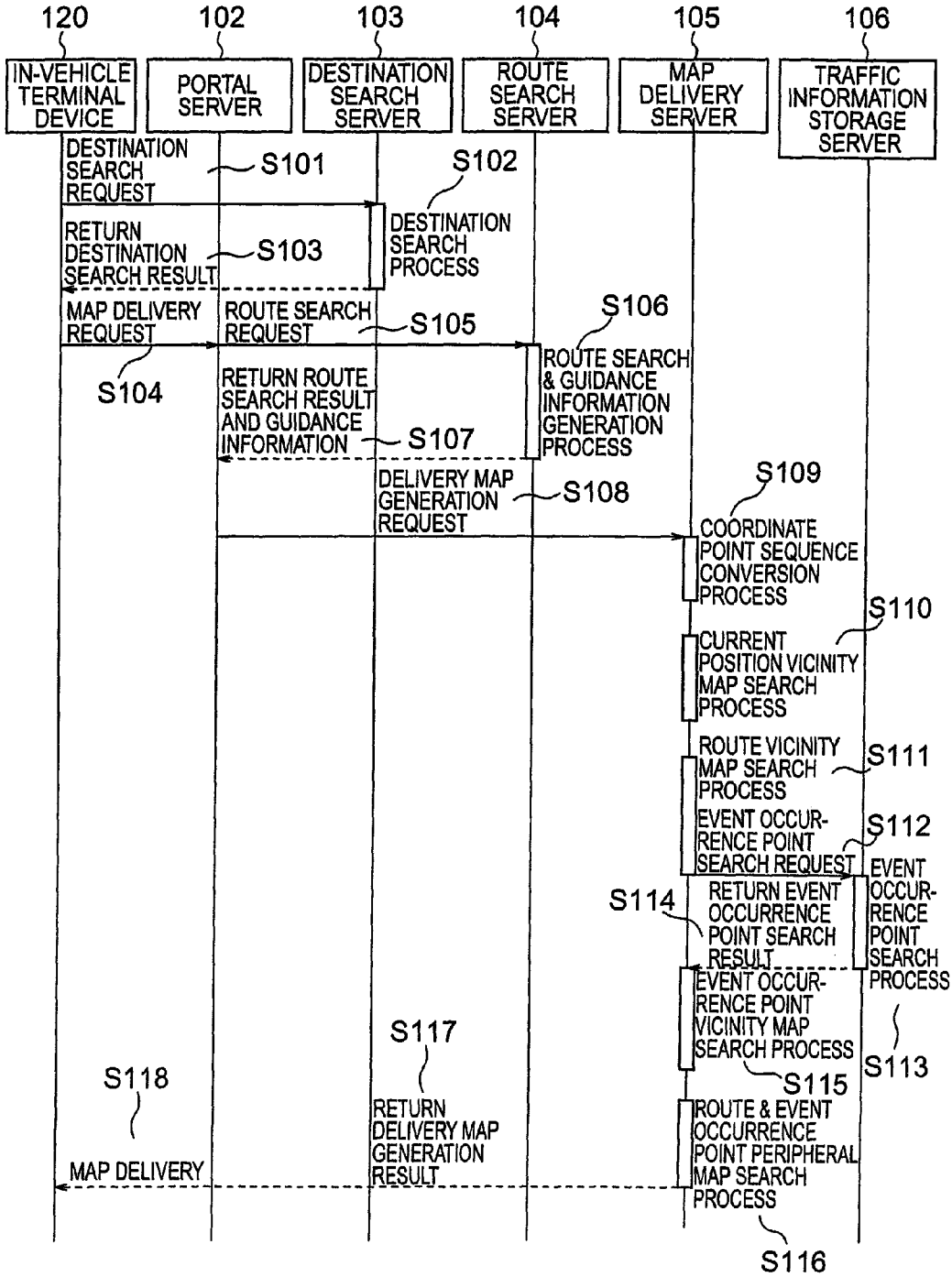
FIG. 2 is a sequence chart for explaining processes executed in a first embodiment of the present invention.

In the following, the operation of the communicating navigation system of the first embodiment of the present invention will be described referring to a sequence chart of FIG. 2. In this embodiment, the display mode of the map information supplied from the route information supply system 100 in the route search is changed based on the traffic information obtained from the traffic information supply server 110.

First, the terminal device 120 transmits a destination search request to the destination search server 103 via the portal server 102 (S101). The destination search request contains search conditions such as an address and a type of facility which have been inputted by the user.

The destination search module 103*a* of the destination search server 103 searches the destination DB 103*b* and thereby extracts a record satisfying the search conditions (S102). After the search, the destination search module 103*a* transmits the name, address, positional information (latitude, longitude, etc.), etc. contained in the extracted record to the terminal device 120 as the search result (S103). When there are two or more records satisfying the search conditions, all such records are sent to the terminal device 120 as the search result.

When the search result regarding the destination is received from the destination search server 103, the terminal device 120 displays the names, etc. contained in the search result and thereby requests the user to determine the destination. In this step, the terminal device 120 may receive inputs for setting the route search conditions (e.g. whether an expressway, toll road, etc. may be used or not). The terminal device 120 also determines its current position by its position locating function.

After the destination determined by the user is inputted (together with the route search conditions as needed), the terminal device 120 transmits a map delivery request (designating the current position and the determined destination as the start point and the end point respectively and containing the route search conditions if they have been set by the user) to the portal server 102 (S104).

The portal server 102 which received the map delivery request generates a route search request by adding management information (request ID information, etc.) to the map delivery request and sends the route search request to the route search server 104 (S105).

The route search module 104*a* and the guidance information generation module 104*b* of the route search server 104 carry out a route search & guidance information generation process based on start/end point information contained in the route search request received from the portal server 102 (S106). In this step, if the route search conditions are included in the received route search request, the route search process is executed taking the route search conditions into consideration. Route search information and guidance information generated by the process are sent to the portal server 102 (S107).

The portal server 102 which received the route search information and the guidance information transmits a delivery map generation request to the map delivery server 105 (S108). The delivery map generation request is generated to contain management information (request ID, etc.), the start/end point information, route data information and guidance data information, for example.

The map delivery server 105 which received the delivery map generation request executes a coordinate point sequence conversion process based on the start/end point information, the route data information, the guidance data information, etc. contained in the delivery map generation request (S109).

Subsequently, the map delivery server 105 carries out a current position vicinity map search process (S110) and a route vicinity map search process (S111).

In the current position vicinity map search process (S110), map information on an area containing the start point is generated using the map data of the map level 1, by which detailed map information is generated for an area in the vicinity of the current position as the start point.

The area containing the start point may be set as an area inside a circle or rectangle of a prescribed size with its center at the start point, an area inside a mesh containing the start point, an area inside a mesh group (group of meshes) adjacently containing the mesh containing the start point, etc.

In the route vicinity map search process (S111), map information on an area containing the route is generated using the map data of the map level 1, by which detailed map information is generated for an area along the route.

The area containing the route may be set as an area along the route within a prescribed distance from the route, an area inside meshes containing the route, etc.

Subsequently, the map delivery server 105 sends a traffic event occurrence point search request to the traffic information storage server 106 (S112). The traffic event occurrence point search request is generated to contain a request ID and search range information, for example.

The search range may include an area range, a time range, an event range and a significance range, for example.

The area range may be set as a rectangle of a prescribed size containing the start point, the end point and the route. The area range may be set to be identical with an area for displaying the map information. The time range may be set to a time interval which is obtained by multiplying necessary time (which is obtained when the route is calculated) by a prescribed coefficient. The event range indicates which types of event (accident, congestion, etc.) should be taken into consideration as the route information. The significance range indicates the degree(s) of significance of events that should be regarded as search targets out of the events to be taken into consideration. These search ranges may either be set previously or set according to instructions by the user.

The traffic information storage server 106 which received the event occurrence point search request carries out an event occurrence point search process (S113). In the event occurrence point search process, the data processing module 106*a* searches the traffic information storage DB 106*b* for records satisfying the search range and the time range.

After the search, the data processing module 106*a* sends the result of the search to the map delivery server 105 as an event occurrence point search result (S114).

The map delivery server 105 executes an event occurrence point vicinity map search process based on the event occurrence point search result (S115).

In the event occurrence point search result (S115), map information on each area containing each event occurrence point is generated using the map data of the map level 1, by which detailed map information is generated for each area containing each event occurrence point.

Each area containing each event occurrence point may be set as an area inside a circle or rectangle of a prescribed size with its center at the event occurrence point, an area inside a mesh containing the event occurrence point, an area inside a mesh group (group of meshes) adjacently containing the mesh containing the event occurrence point, etc.

Subsequently, the map delivery server 105 executes a route & event occurrence point peripheral map search process (S116).

In the route & event occurrence point peripheral map search process, map information on areas to be displayed as the map information, other than the areas for which the map information has already been generated using the map data of the map level 1, is generated using coarser map data (e.g. map data of the map level 3), by which areas distant from the start/end points, the route and the event occurrence points can be displayed by rough map display and thereby the amount of data for the map information display can be reduced.

The map delivery server 105 sends the generated map information to the portal server 102 (S117) and the portal server 102 delivers the map information to the terminal device 120 (S118).

The terminal device 120 which received the map information displays a screen according to the map information, by which the user can obtain the route information to which the traffic information has been added, at the point of the route search.

The map information generated by the above process will be schematically explained below.

Figure 3:
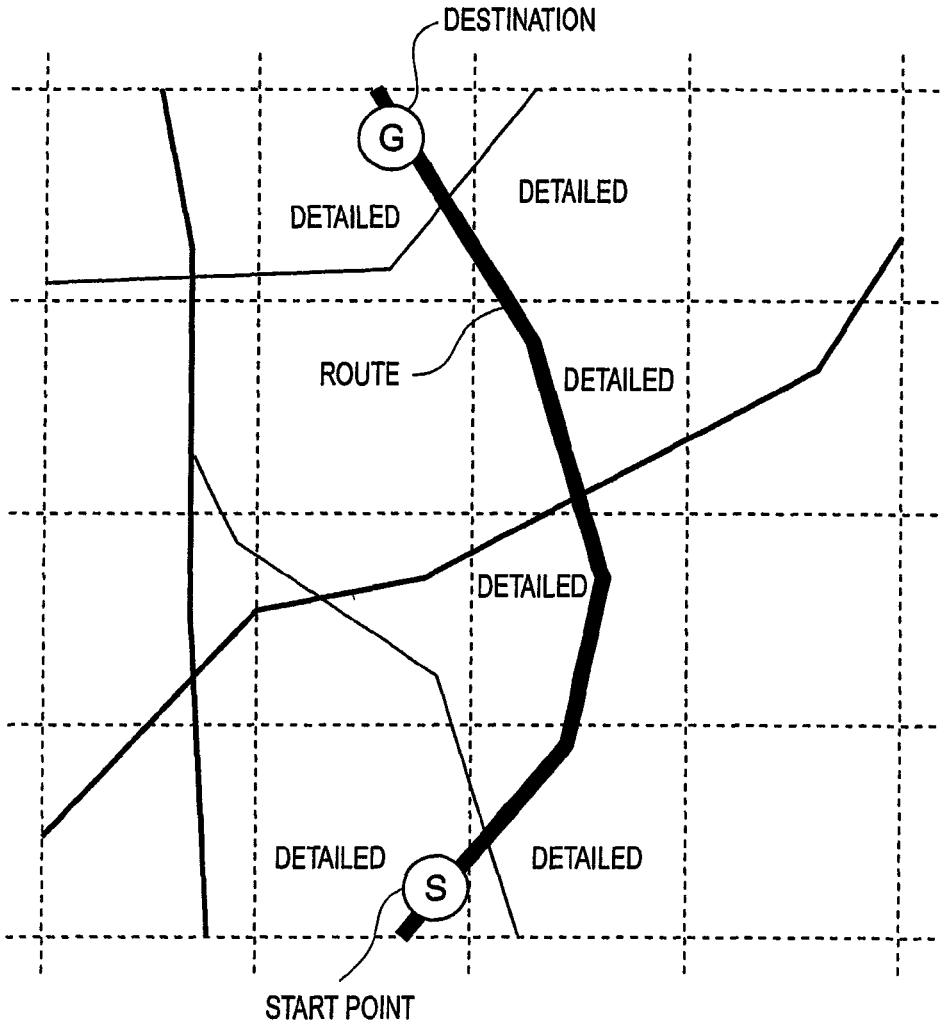
FIG. 3 is a diagram schematically showing map information which is generated by the first embodiment.

FIG. 3 schematically shows the map information when no event satisfying the conditions is found in the event occurrence point search process (S113). The map information in this case is identical with conventional map information which includes no traffic information.

In the example of FIG. 3, detailed map information of the map level 1 is generated in units of meshes which are partitioned by the broken lines, and a screen according to the generated map information is displayed. Consequently, detailed maps of the map level 1 are displayed for a mesh containing the start point (S), a mesh containing the end point (G) and meshes containing the route, while coarse maps of the map level 3 are displayed for the other meshes.

Figure 4:
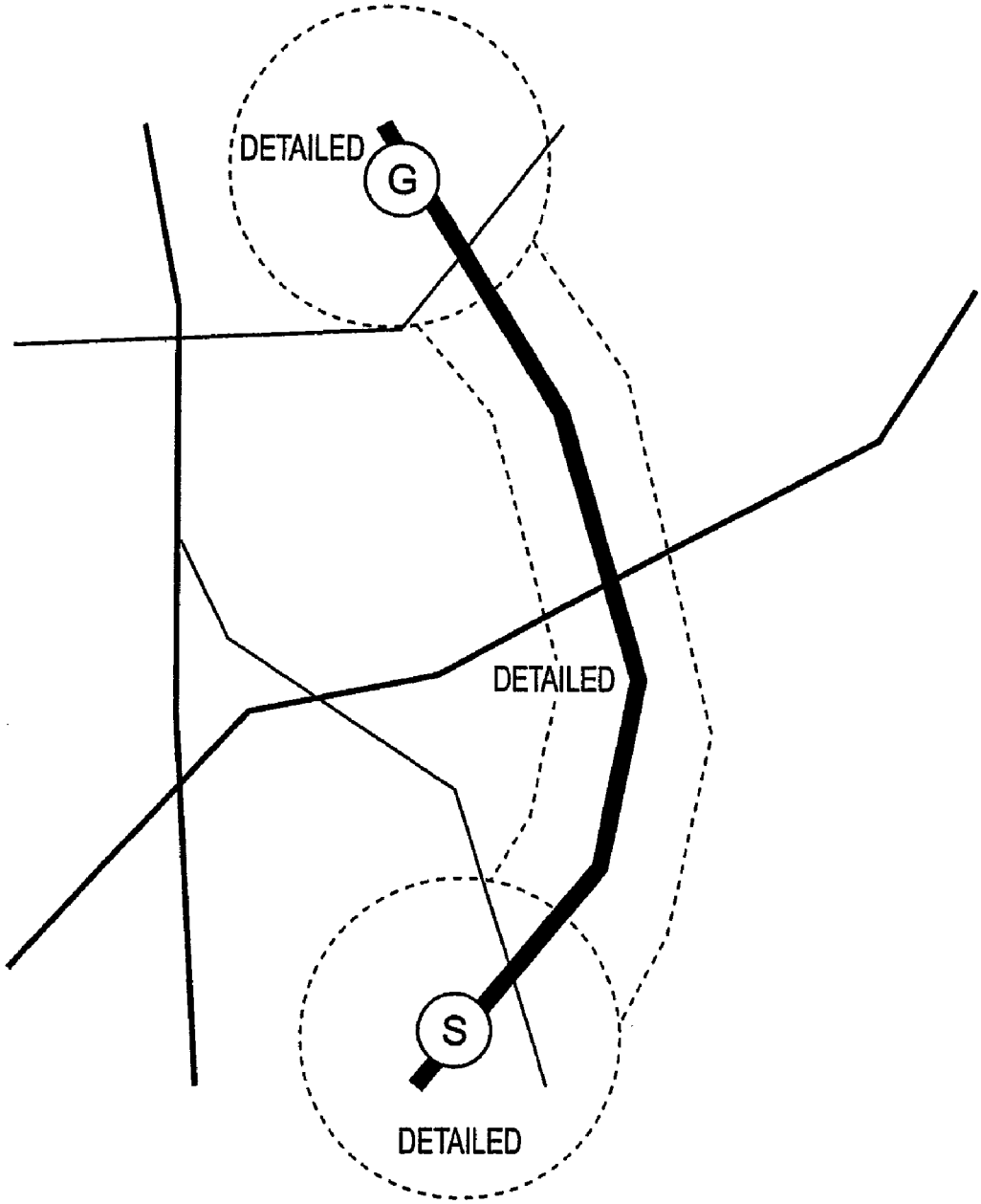
FIG. 4 is a diagram schematically showing map information which is generated by the first embodiment.

In cases where the units of generating detailed map information of the level 1 are set as a circle of a prescribed size around the start point, a circle of a prescribed size around the end point and a range along the route within a prescribed distance from the route, the map display becomes like the one shown in FIG. 4.

Figure 5:
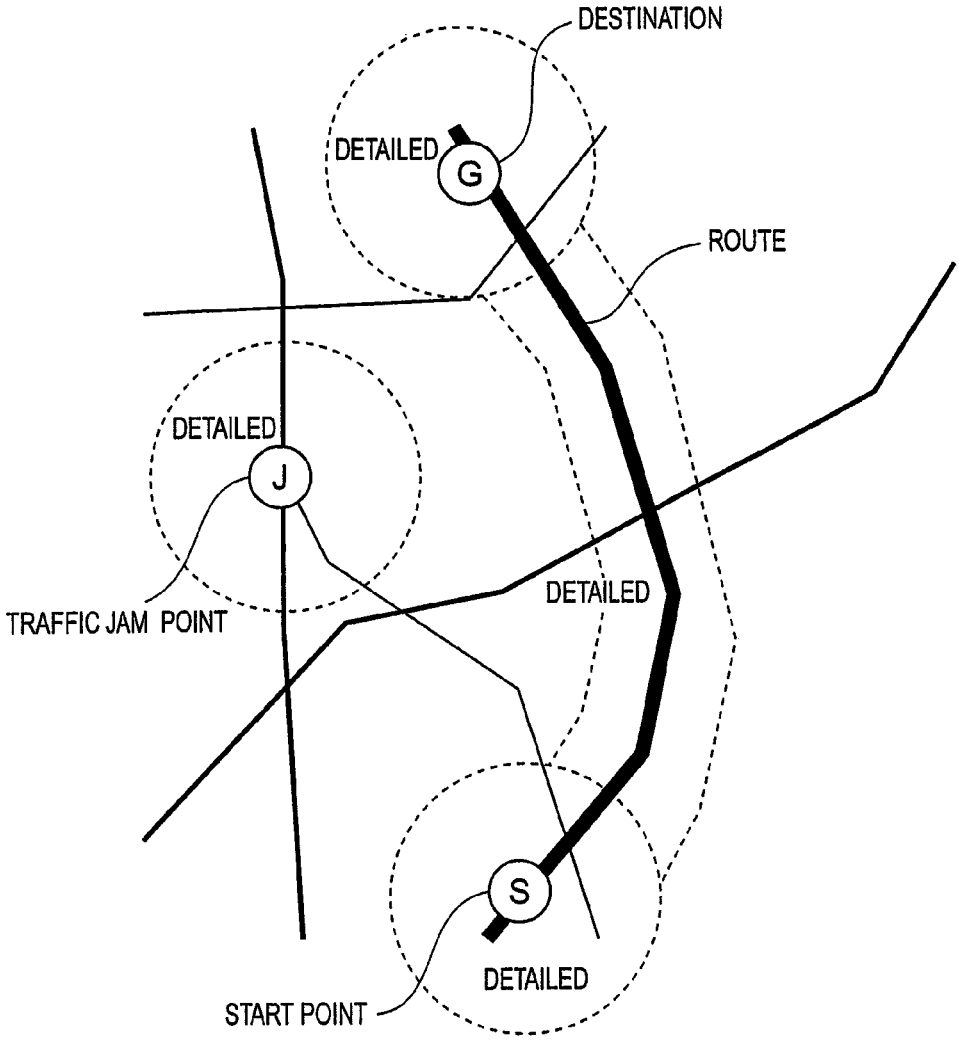
FIG. 5 is a diagram schematically showing map information which is generated by the first embodiment.

Meanwhile, FIG. 5 schematically shows the map information when a traffic jam (congestion) is extracted as an event in the event occurrence point search process (S113). In the example of FIG. 5, the units of generating detailed map information of the level 1 are set as a circle of a prescribed size around the start point, a circle of a prescribed size around the end point, a circle of a prescribed size around the event occurrence point and a range along the route within a prescribed distance from the route.

In the example of FIG. 5, a detailed map is displayed also for the circular area of the prescribed size around the traffic jam point (J), in addition to the map display of FIG. 4.

As above, the user can obtain detailed map information on the area around the traffic jam point, at the point of the route search.

Incidentally, map information actually displayed on the terminal device 120 further includes guidance information, a button for changing the reduction scale, a button for requesting display of detailed information on traffic events, a scroll guide, etc.

In the following, the operation of a communicating navigation system in accordance with a second embodiment of the present invention will be described referring to a sequence chart of FIG. 6. In this embodiment, the traffic information is taken into consideration in the route search and detailed maps are displayed also for areas around a detour route.

Figure 6:
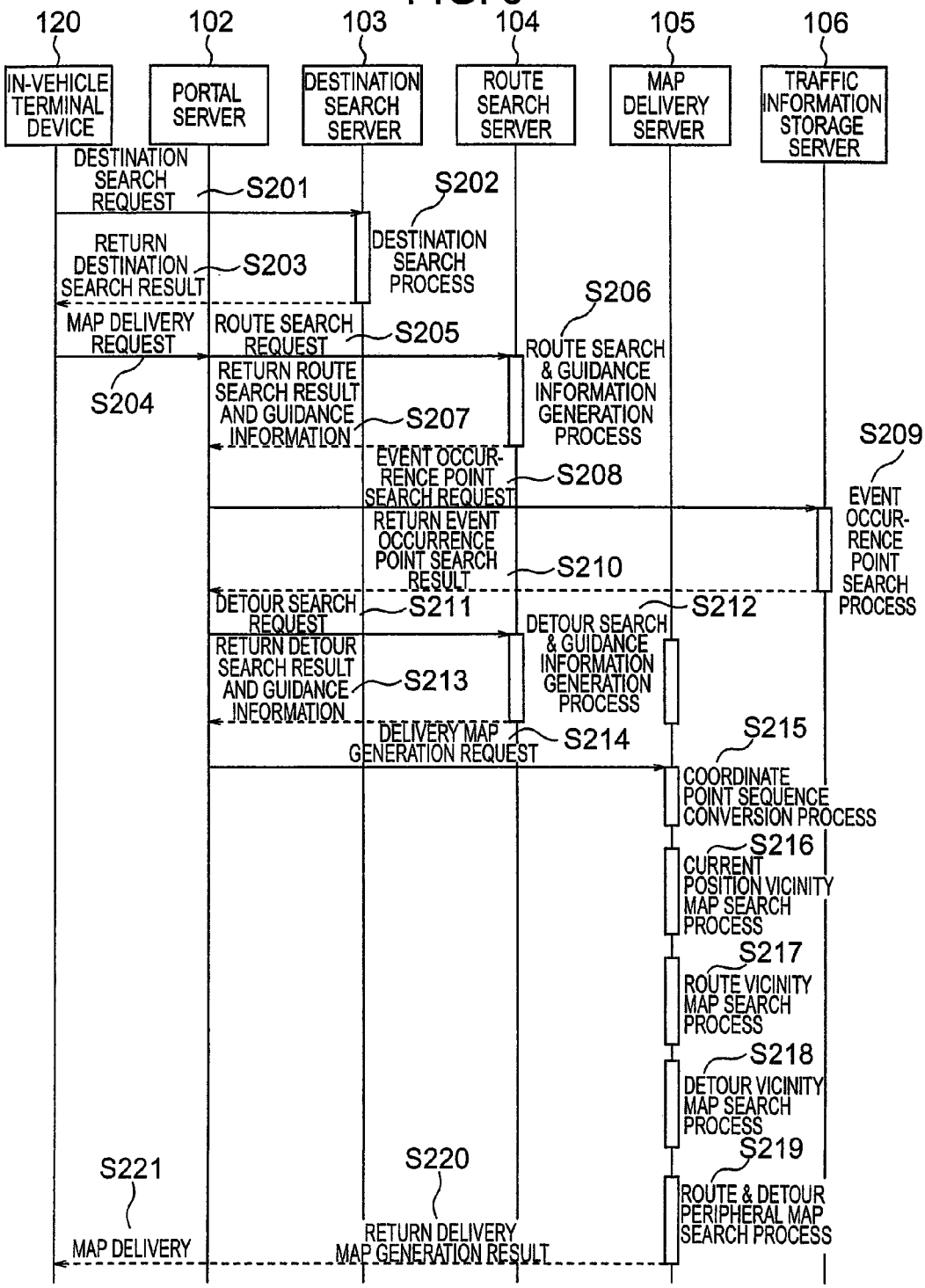
FIG. 6 is a sequence chart for explaining processes executed in a second embodiment of the present invention.

In FIG. 6, steps S201-S207 are identical with the steps S101-S107 of the first embodiment. Incidentally, the route obtained in the step S206 will be referred to as a "main route" so that it can be distinguished from a detour which will be explained later.

The portal server 102 which received the route search result and the guidance information transmits an event occurrence point search request to the traffic information storage server 106 (S208). The event occurrence point search request is identical with that in the first embodiment (S112).

An event occurrence point search process (S209) and an event occurrence point search result return (S210) executed by the traffic information storage server 106 for the event occurrence point search request are substantially identical with those (S113, S114) in the first embodiment, except that the event occurrence point search result is returned to a different destination.

The portal server 102 which received the event occurrence point search result sends a detour search request to the route search server 104 (S211). The detour search request transmitted to the route search server 104 includes link IDs and link costs which are contained in the event occurrence point search result, in addition to the contents of the route search request sent in the step S205.

The route search server 104 carries out a detour search & guidance information generation process based on the detour search request (S212). The process is basically the same as the route search & guidance information generation process (S106) in the first embodiment; however, the process is executed after the link cost data stored in the search DB 104*c* of the route search server 104 have been updated to those contained in the detour search request. Thereafter, the results of the process are returned to the portal server 102 as detour information and a guidance information result (S213).

The portal server 102 which received the result of detour search and guidance information sends a delivery map generation request to the map delivery server 105 (S214). The delivery map generation request may include a request ID, start/end point information, and route data information and guidance data information on the main route and the detour.

The map delivery server 105 which received the delivery map generation request executes a coordinate point sequence conversion process based on the start/end point information, the route data information, the guidance data information, etc. contained in the delivery map generation request (S215). The process is basically the same as the coordinate point sequence conversion process (S109) in the first embodiment, except that the conversion is carried out not only for the main route but also for the detour.

Subsequently, the map delivery server 105 carries out a current position vicinity map search process (S216) and a route vicinity map search process (S217). The processes are identical with the current position vicinity map search process (S110) and the route vicinity map search process (S111) in the first embodiment.

In this embodiment, the map delivery server 105 further carries out a detour vicinity map search process (S218). In the detour vicinity map search process, a process similar to the route vicinity map search process (S217) is executed for the detour, by which detailed map information is generated also for an area along the detour.

Subsequently, the map delivery server 105 executes a route & detour peripheral map search process (S219). In the route & detour peripheral map search process, map information on areas to be displayed as the map information, other than the areas for which the map information has already been generated using the map data of the map level 1, is generated using coarser map data (e.g. map data of the map level 3), by which areas distant from the start/end points, the route and the detour route can be displayed by rough map display and thereby the amount of data for the map information display can be cut down.

Thereafter, the map delivery server 105 sends the generated map information to the portal server 102 (S220) and the portal server 102 delivers the map information to the terminal device 120 (S221).

Figure 7:
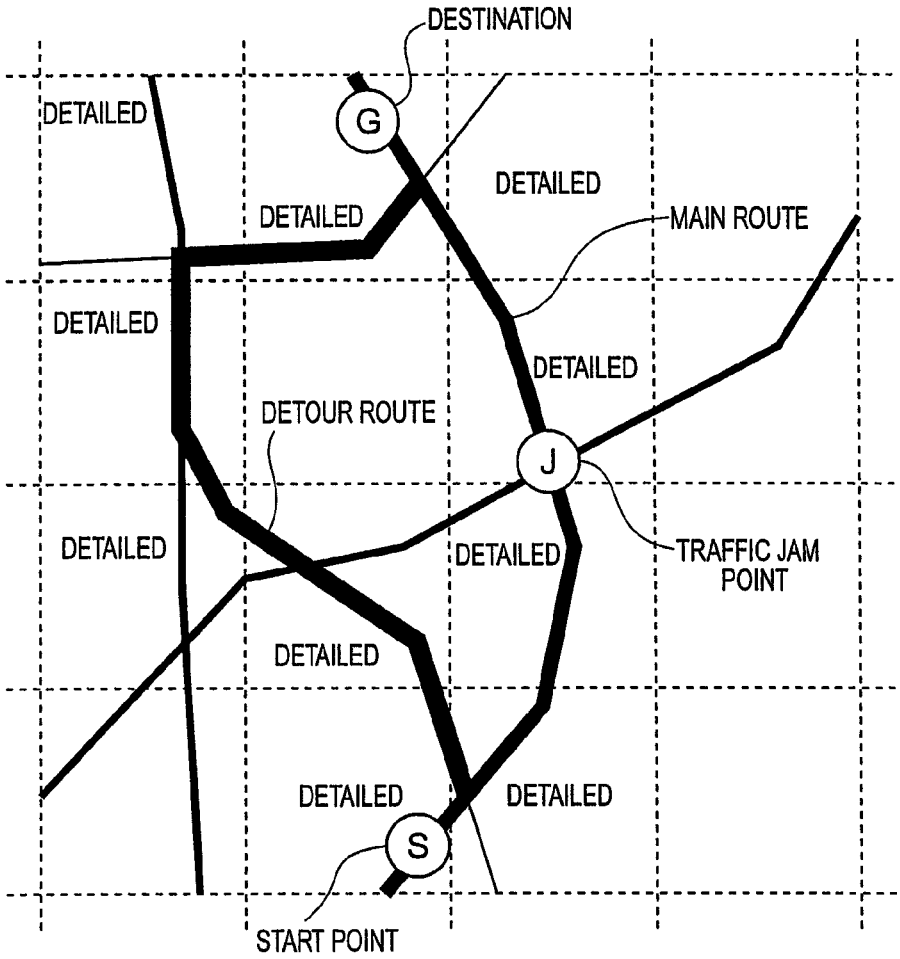
FIG. 7 is a diagram schematically showing map information which is generated by the second embodiment.

FIG. 7 is a diagram schematically showing the map information generated by the above processes. In the example of FIG. 7, detailed maps of the map level 1 are displayed in units of meshes which are partitioned by the broken lines. As shown in FIG. 7, by the above processes, detailed maps of the map level 1 are displayed for a mesh containing the start point (S), a mesh containing the end point (G), a mesh containing the traffic jam point (J), meshes containing the main route and also for meshes containing the detour route, while coarse maps of the map level 3 are displayed for the other meshes.

In the second embodiment described above, in response to the map delivery request (S204) from the terminal device 120, the route information supply system 100 generates map information containing two routes (the main route considering no traffic information and the detour considering the traffic information) and delivers the map information to the terminal device 120.

Figure 8:
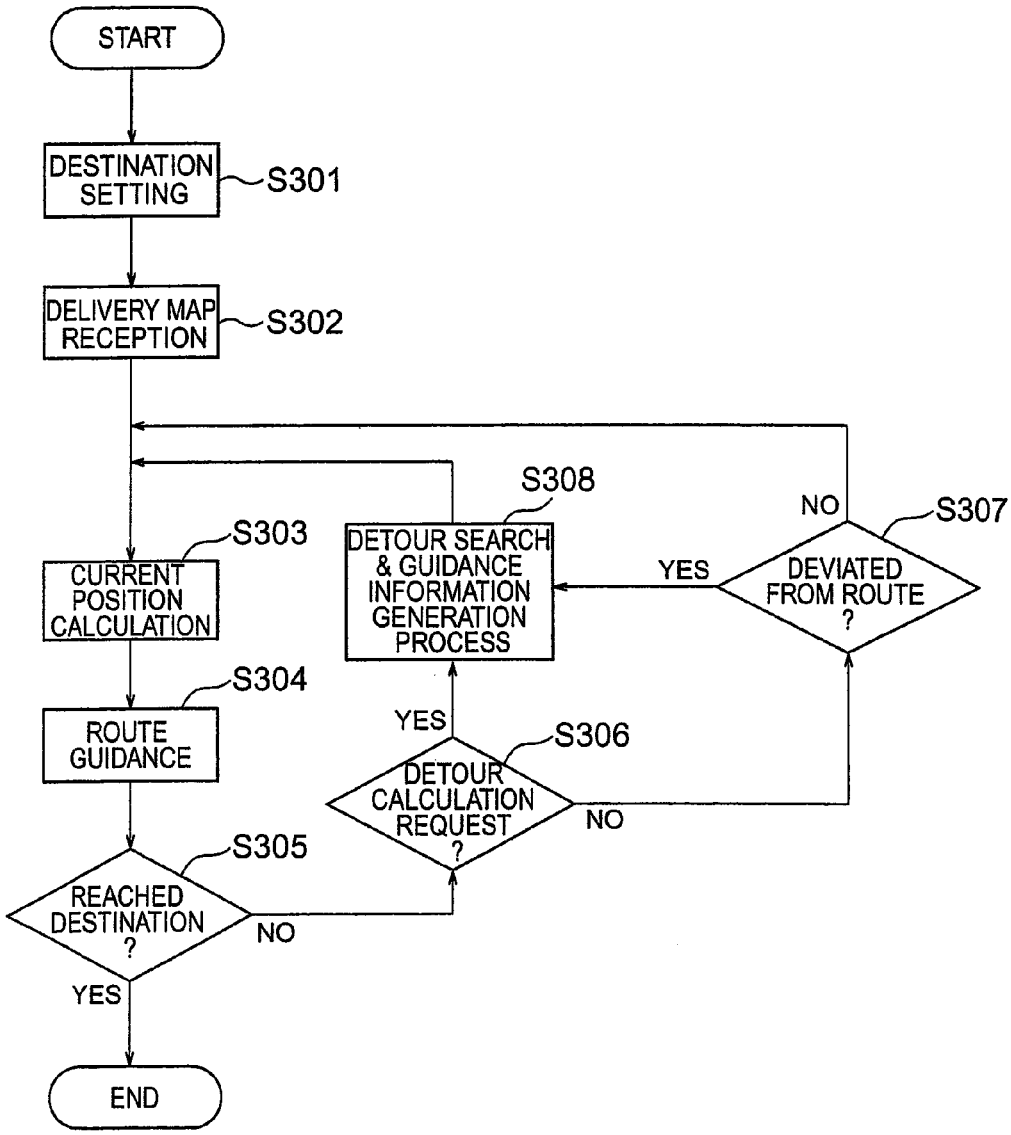
FIG. 8 is a flow chart for explaining processes executed in a third embodiment of the present invention.

Meanwhile, it is also possible to let the terminal device 120 search for a detour based on the aforementioned map information that is delivered to the terminal device 120 in the first embodiment. In the following, the operation of the terminal device 120 in this case will be described referring to a flow chart of FIG. 8, as a third embodiment of the present invention.

In a destination setting process (S301), the terminal device 120 transmits a destination search request to the portal server 102 and thereafter receives a destination search result. The process corresponds to the steps S101-S103 of the first embodiment.

The next delivery map reception process (S302) corresponds to the steps S104-S118 of the first embodiment.

Subsequently, the terminal device 120 determines its current position by its position locating function (S303) and gives route guidance based on the map received in the delivery map reception process of the step S302 (S304).

In step S305, the terminal device 120 judges whether it has reached the destination or not based on the current position determined in the step S303.

If the terminal device 120 judges that the destination has been reached (S305: YES), the process is ended.

If the terminal device 120 judges that the destination has not been reached yet (S305: NO), the terminal device 120 repeats the steps S303 and S304 while checking whether or not the user has made a detour calculation request by a prescribed operation (S306).

If the detour calculation request has been detected (S306: YES), the terminal device 120 executes a detour search & guidance information generation process (S308).

If no detour calculation request has been detected (S306: NO), the terminal device 120 checks whether or not it has deviated from the route (S307). Also when the deviation is detected (S307: YES), the terminal device 120 executes the detour search & guidance information generation process (S308).

In the detour search & guidance information generation process (S308), a detour is searched for and guidance information is generated based on the delivered map data. Specifically, the route search module 104*a*, the guidance information generation module 104*b* and the search DB 104*c* installed in the route search server 104 are also installed in the terminal device 120, and the detour search & guidance information generation process explained in the second embodiment (S212) is executed by the terminal device 120.

Incidentally, the map information received in the delivery map reception process (S302) does not include guidance information regarding roads other than the main route. Therefore, it is desirable that the terminal device 120 be provided with a function for generating the guidance information based on road names, link information, etc. regarding the detour route contained in the delivered map information.

After the detour search & guidance information generation process (S212), the terminal device 120 repeats the process from the step S303.

Figure 9:
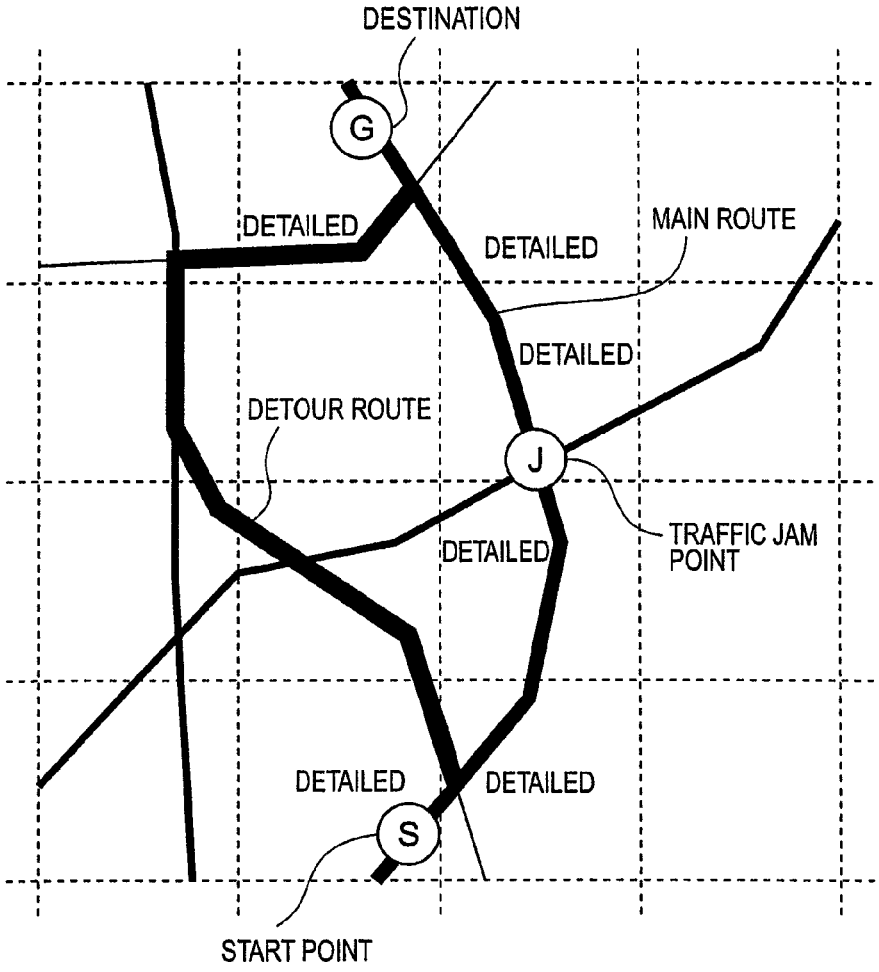
FIG. 9 is a diagram schematically showing map information which is generated by the third embodiment.

FIG. 9 is a diagram schematically showing the map information generated by the above processes. In the example of FIG. 9, detailed maps of the map level 1 are displayed in units of meshes which are partitioned by the broken lines. As shown in FIG. 9, by the above processes, detailed maps of the map level 1 are displayed for a mesh containing the start point (S), a mesh containing the end point (G), a mesh containing the traffic jam point (J) and meshes containing the main route, while coarse maps of the map level 3 are displayed for the other meshes. Further, the detour route calculated by the terminal device 120 is displayed.

While a case where the terminal device 120 carries out the detour search and the guidance information generation has been explained in the above third embodiment, the terminal device 120 may also request the route information supply system 100 to execute the detour search & guidance information generation process. Specifically, after receiving the delivered map in the step S118 of the first embodiment, the terminal device 120 may transmit a request (requesting the route information supply system 100 to execute the detour search & guidance information generation process of the second embodiment) to the portal server 102.

In the map delivery (S118) in response to the route search request (S105), it is possible to let the route information supply system 100 first deliver map information considering no traffic information and thereafter deliver map information considering the traffic information together with the detour route to the terminal device 120 when a detour search request is received from the terminal device 120.

In the following, the operation of a communicating navigation system in accordance with a fourth embodiment of the present invention will be described referring to a sequence chart of FIG. 10.

Figure 10:
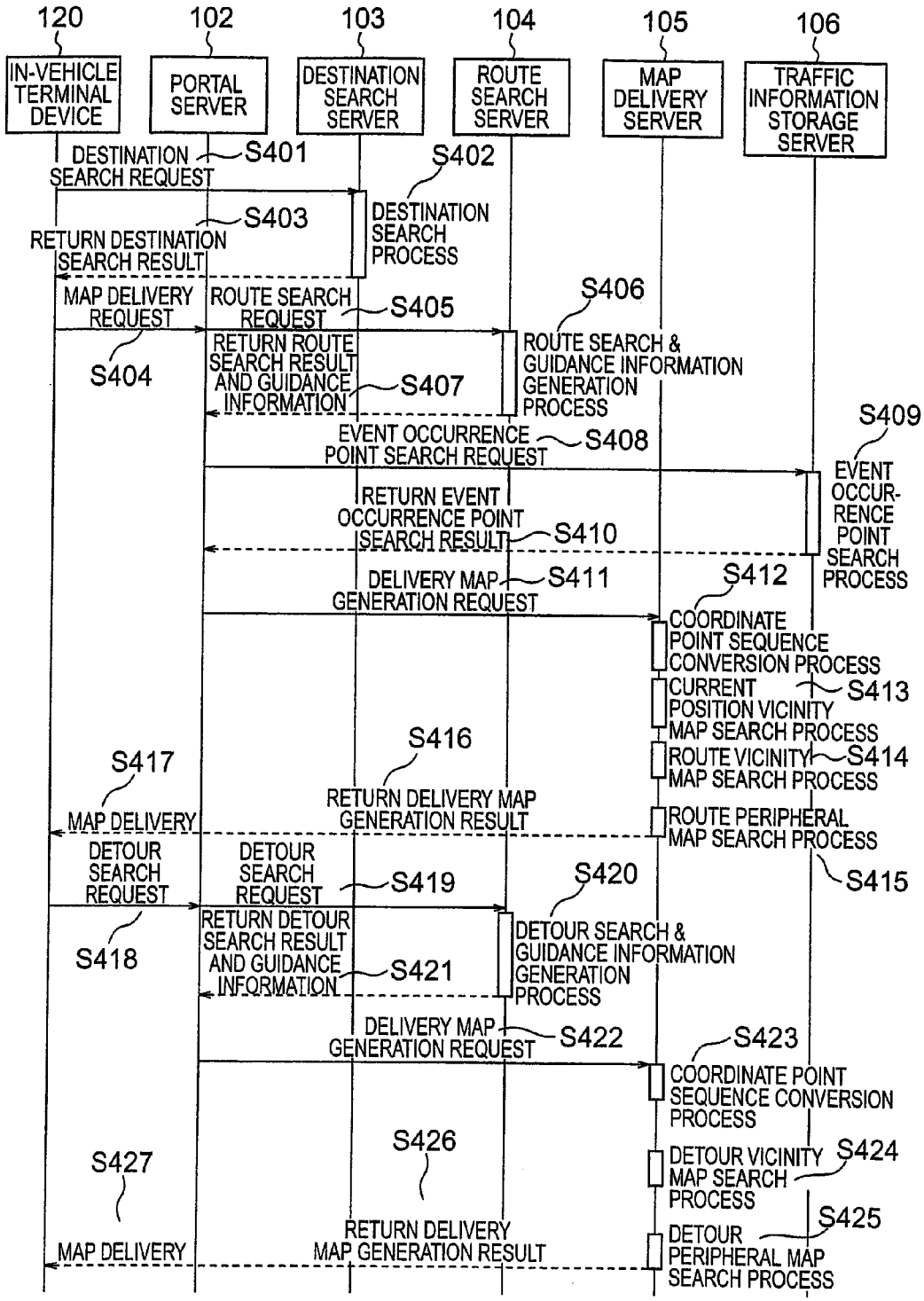
FIG. 10 is a sequence chart for explaining processes executed in a fourth embodiment of the present invention.

In FIG. 10, steps S401-S410 are the same as the steps S201-S210 of the second embodiment. Steps S411-S414 are the same as the steps S214-S217 of the second embodiment.

Subsequently, peripheral maps for the main route considering no traffic information are searched for (S415) and map information obtained by the above steps is delivered to the terminal device 120 (S416, S417).

Thereafter, when a detour search request is transmitted by the terminal device 120 to the portal server 102 (S418), the portal server 102 sends the detour search request to the route search server 104 (S419).

The route search server 104 carries out a detour search & guidance information generation process (S420) and returns detour information and a guidance information result to the portal server 102 (S421).

The portal server 102 which received the result of detour search and guidance information sends a delivery map generation request for the detour to the map delivery server 105 (S422). The delivery map generation request may include a request ID, start/end point information, and route data information and guidance data information on the detour.

The map delivery server 105 which received the delivery map generation request executes a coordinate point sequence conversion process for the detour (S423).

Subsequently, the map delivery server 105 carries out a detour vicinity map search process (S424) and a detour peripheral map search process (S425). The processes can be carried out similarly to the aforementioned map search processes of the second embodiment. By the processes, detailed map information is generated also for an area along the detour. Areas distant from the start/end points, the route and the detour route can be displayed by rough map display, by which the amount of data for the map information display can be reduced.

Thereafter, the map delivery server 105 sends the generated map information to the portal server 102 (S426) and the portal server 102 delivers the map information to the terminal device 120 (S427).

The map information generated by the above processes is identical with that of the second embodiment.

In the following, an embodiment of a map display system employing the present invention will be described as a fifth embodiment of the present invention, taking a navigation system as an example.

First, the composition of the navigation system of this embodiment will be explained referring to FIG. 11.

Figure 11:
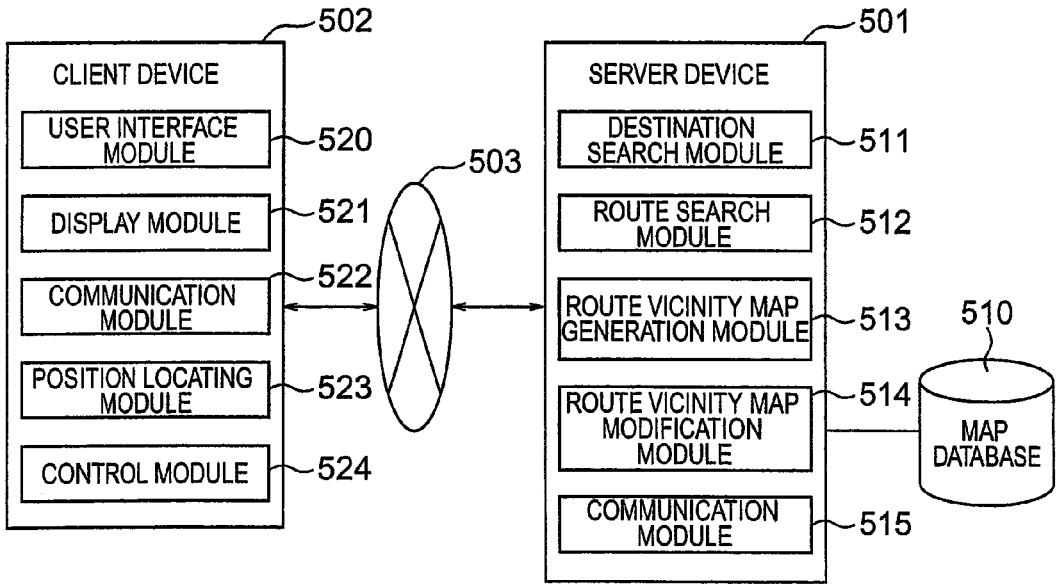
FIG. 11 is a block diagram showing a map display system in accordance with an embodiment of the present invention.

The navigation system shown in FIG. 11 has a function of cutting out a route vicinity map of a limited area which is necessary for the screen display in the route guidance and thereby generating the map data efficiently. The route vicinity map is a map which covers the route from the guidance start point to the destination designated by the user. Therefore, the navigation system includes a server device 501 which generates the route vicinity map, a client device 502 which presents the route vicinity map to the user, and a network 503 which is used for the transmission of the route vicinity map.

In the following, each device forming the navigation system of this embodiment will be described more concretely. First, the server device 501 includes a map database 510, a destination search module 511 for searching for and setting the destination, a route search module 512 which searches for a route between two designated points by a mathematical calculation method such as the Dijkstra algorithm, a route vicinity map generation module 513 which generates a vicinity map of the route, a route vicinity map modification module 514 which modifies the route vicinity map so as to reduce the amount of map data to be transmitted, and a communication module 515 as an interface for the communication with other terminals. The communication module 515 is connected to the network 503. The map database 510 stores data such as map element data including road data, background data (of water systems, green zones, etc.), name data, etc., facility information on restaurants, airports, etc., average travel time and distance information on each prescribed section (between prescribed intersections), and traffic regulation information so that the data can be referred to in the destination search, the route search and the route vicinity map generation process. The client device 502 includes a user interface module 520, a display module 521, a communication module 522, a position locating module 523 and a control module 524. To the user interface module 520, switches (scroll keys, reduction scale alteration keys, etc.), a joystick, a touch panel, a microphone (as an input means for the user to the client device 502) and a speaker (as an output means for the client device 502 to the user) are connected, for example. The display module 521 is generally implemented by a CRT, a liquid crystal display, etc. The communication module 522, including a data communication means implemented by a cellular phone for example, is used for the communication with the server device 501 and other devices via the network 503. The position locating module 523 determines the position of a vehicle which is equipped with the client device 502. The control module 524 controls the above components of the client device 502. Incidentally, the position locating module 523 is implemented by a GPS, for example. A reception signal from a GPS antenna is inputted to the position locating module 523.

Figure 12:
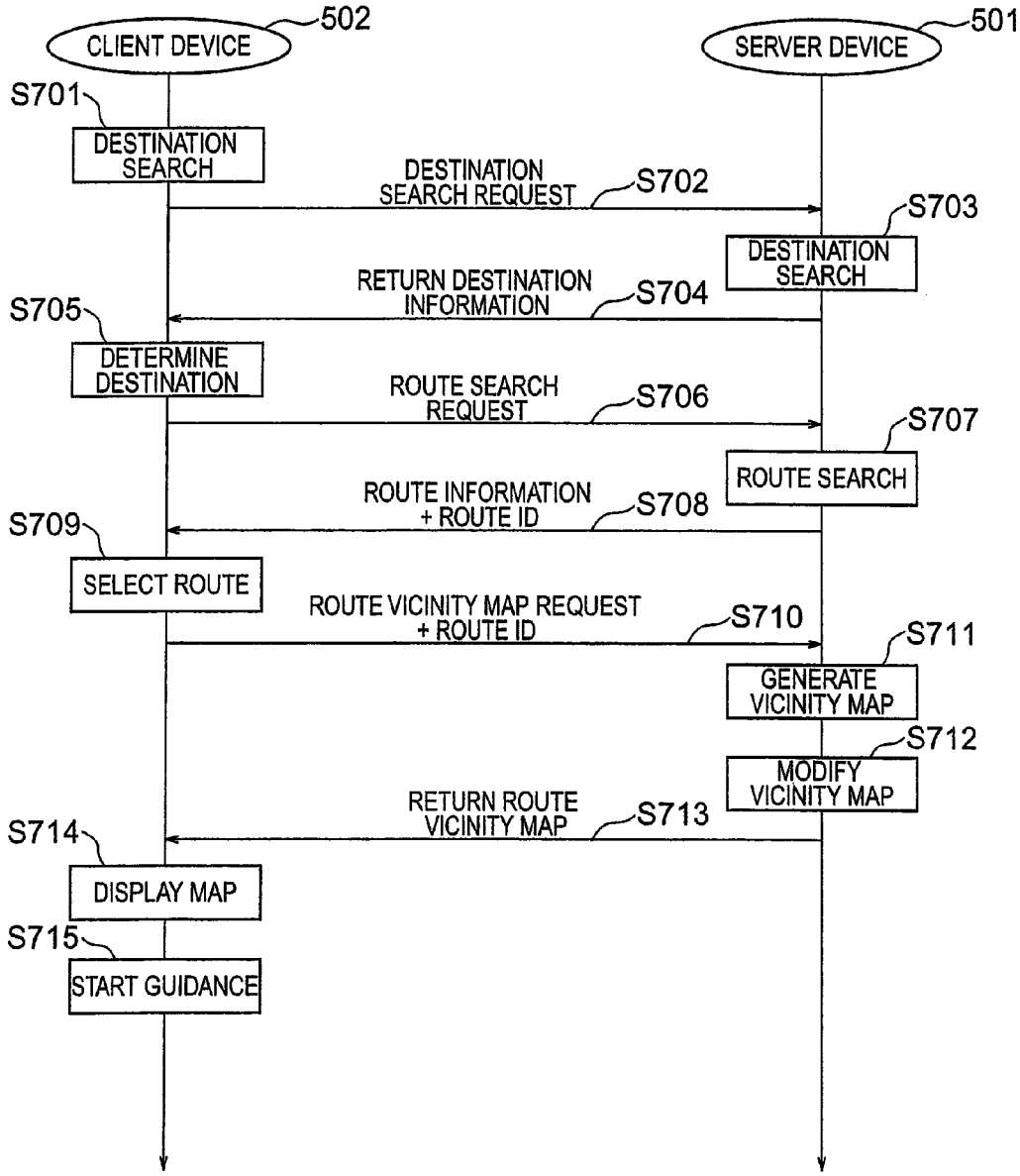
FIG. 12 is an operation sequence chart showing the operation of the system.

FIG. 12 is an operation sequence chart for explaining the operation of the navigation system of FIG. 11, in which the operation sequence between the server device 501 and the client device 502 is shown.

The operation of the navigation system implementing the map display in accordance with the present invention will be explained below referring to the operation sequence of FIG. 12. First, when an information search request is inputted through the user interface module 520 of the client device 502 together with search information (search key) such as the name of the destination (S701), a destination search request together with the search information set as above is issued to the server device 501 (S702). The server device 501 receives the destination search request via the communication module 515, searches for destination information matching the search information (search key) by the destination search module 511 (S703), and returns the search result (address and phone number of each destination, position information, facility information (map around each destination, photograph of the exterior, etc.), reservation status information, congestion information, etc.) to the client device 502 via the communication module 515 (S704). In the client device 2, when the destination is determined by the user out of the destination information returned from the server device 501 (S705), a route search request is issued to the server device 501 (S706). In this step, the user can designate search conditions such as time preference, distance preference, scenery preference, cost preference, etc., by which a route suiting the preference of the user can be found. The user can also designate the number of routes to be searched for and a plurality of search conditions, by which two or more routes can be found. In the server device 501 which received the route search request, the route search module 512 carries out the route search by referring to the map database 510 based on the current position (or a designated point) and the destination (S707). Route information outputted by the route search module 512 is returned to the client device 502 together with route identification information (route ID) (S708). The route information returned to the client device 502 can be information on two or more routes that satisfy the designated search conditions or that are figured out from various search conditions like the time preference, distance preference, scenery preference, cost preference, etc. By returning information on characteristics of each route (distance and necessary time to the destination, etc.) together with the route information, it is possible to let the user make a selection through his/her preference.

The data format of the route information can be vector data with coordinate values, bitmap data, etc. In the case of bitmap data, data obtained by drawing (spreading the data of) the route from the start point to the destination on the map is used; however, it is also possible to use a certain type of data that can be displayed being combined with the map data by spreading the map data and the route data as separate images and setting the background of the route data to a transparent color. In the case where there are two or more routes, each route information is provided with a route number as identification information for identifying the route and a candidate order. The user selects a desired route by designating one of the route numbers. Besides the route number, such identification information for letting the user identify and select a route may include information discriminating among colors, shapes, line types, etc. By associating each route number (identification information) with a color that is used for displaying the route data, it becomes possible to display only a necessary route when the route has been selected by the user (by displaying routes other than the selected route with a transparent color in the combining with the map data).

In the client device 502, when a route is selected by the user (or when some kind of operation (pressing an OK button, etc.) for approving a route is made by the user in the case where there is a single route only) (S709), a route vicinity map request with route identification information (route ID) is transmitted to the server device 501 (S710). In the server device 501 which received the route vicinity map request, the route vicinity map generation module 513 generates the route vicinity map based on the route selected by the user (S711), and the route vicinity map modification module 514 executes a modification process for reducing the amount of map data of the route vicinity map while maintaining visibility according to a procedure which will be described later (S712). Thereafter, the route vicinity map is delivered to the client device 502 (S713). The route vicinity map delivered to the client device 502 may either be vector data or image data obtained by spreading and drawing the vector data. If the route vicinity map request is made designating the format of the map data, the server device 501 can generate the peripheral map in the form of the designated image data or vector data and return such data to the client device 502, by which the client device 502 can meet requirements of various map display devices such as cellular phones, in-vehicle terminals and PDAs. The client device 2 displays the route vicinity map received from the server device 501 (S714) and starts the guidance (S715).

Figure 13:
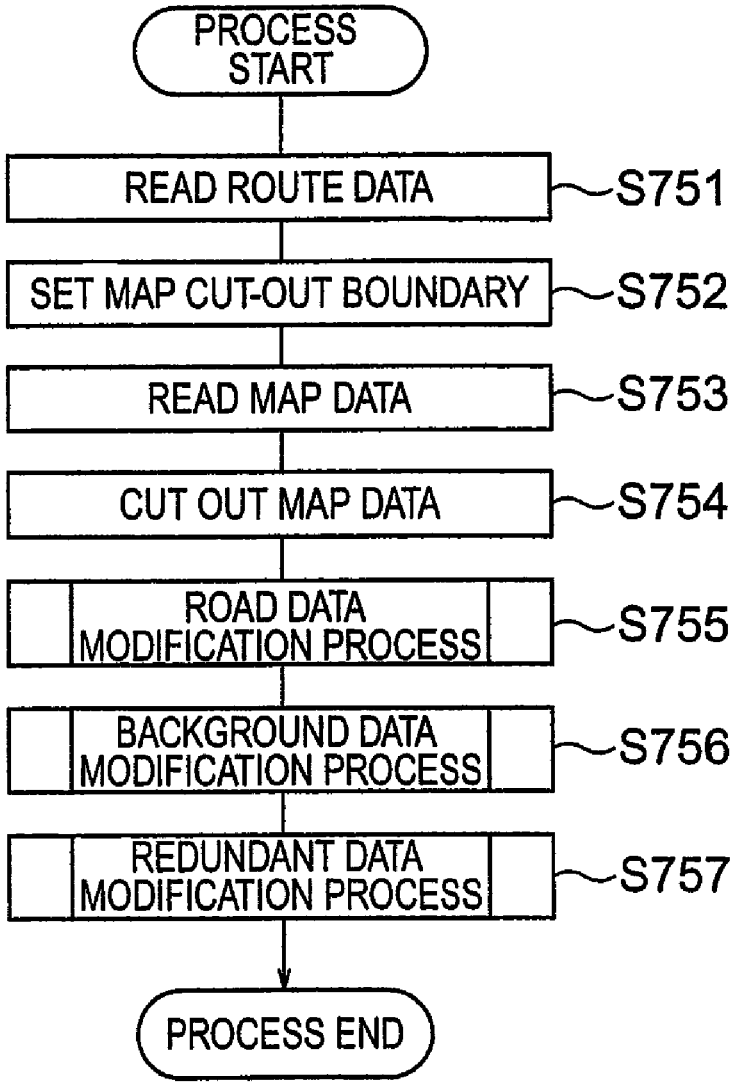
FIG. 13 is a flow chart showing a process for generating a route vicinity map composed of a plurality of areas of different finenesses.
Figure 14:
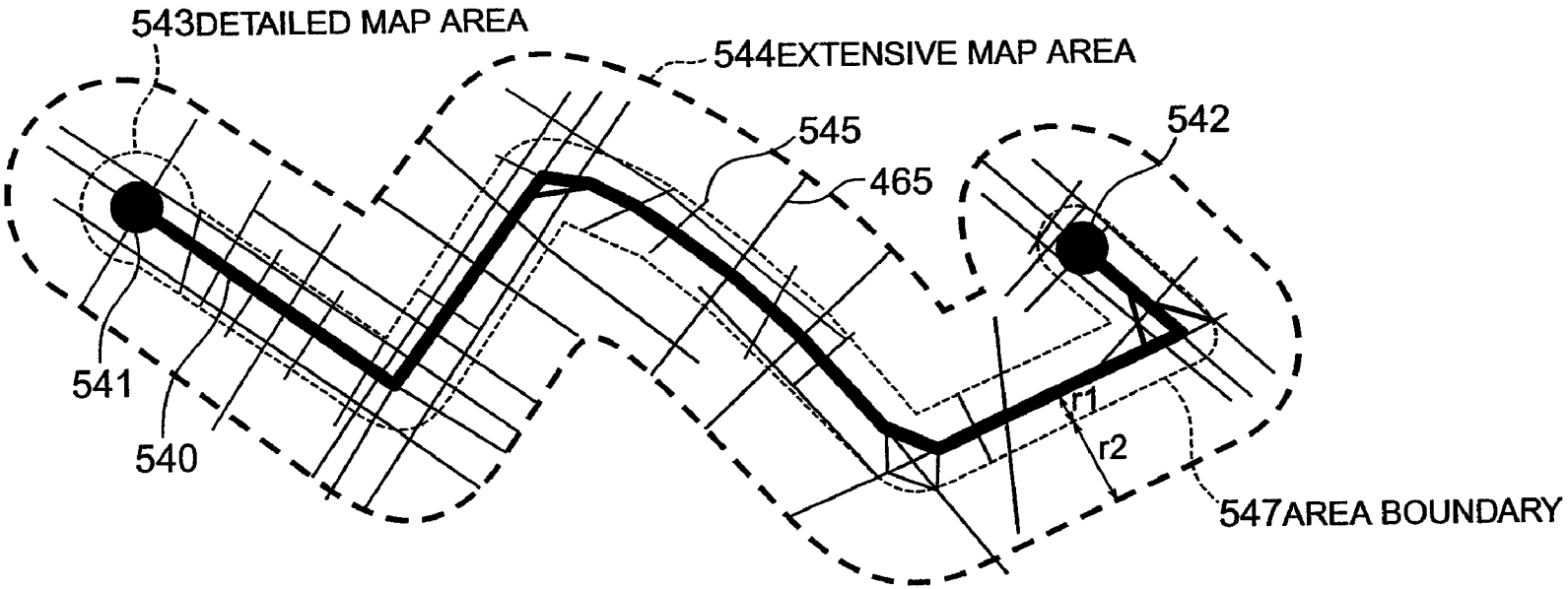
FIG. 14 shows a route vicinity map generated from map data of different map levels with different finenesses.

Next, a method for generating a route vicinity map by reading map data of two or more map levels of different finenesses (e.g. a detailed map and an extensive map (wide area map)) will be explained below referring to FIG. 13. FIG. 14 shows a route vicinity map generated from map data of two or more map levels with different finenesses.

In the route vicinity map generation process, route data of a route 540 from a start point 541 to an end point 542 (outputted by the route search module 512 based on the route ID designated in the step S710) is read out (S751) and a detailed map cut-out area 543 and an extensive map cut-out area 544 are set based on the route data (S752). In the route guidance in this embodiment, the amount of map data transmitted from the server device 501 is reduced by thinning out information or by supplying a summary or outline of information on areas distant from the route while supplying detailed information on areas in the vicinity of the route. Thus the boundary of each map to be cut out is set based on distances r1 and r2 from the route. Specifically, an area within the distance r1 from the route is designated as the detailed map area 543 and an area within a distance range between r1 and r2 from the route is designated as the extensive map area 544. Subsequently, map data for the detailed map area (detailed map data) and map data for the extensive map area (extensive map data) are read out from the map database 510 (S753) and map elements contained in the detailed map area 543 and map elements contained in the extensive map area 544 are cut out from the detailed map data and the extensive map data, respectively (S754). Road data (of roads) intersecting with an area boundary 547 are extracted from the detailed map elements and the extensive map elements which have been cut out from the map data and the shapes of the road data are modified (S755). Meanwhile, the shapes of background data intersecting with the area boundary 547 are also modified repeatedly until all such background data are modified (S756). Further, a redundant data modification process is carried out so that name data representing the same name, etc. will not be displayed redundantly (S757).

By the above process, the route vicinity map composed of map data of different finenesses (detailed map data and extensive map data) is generated. For instance, a road 545 shown in FIG. 14 is a map element that is contained in the detailed map data but is not contained in the extensive map data. Part of the road 545 protruding through the area boundary 547 to the extensive map area is cut off in the step S754. Meanwhile, a road 546 is a map element that is contained both in the detailed map data and in the extensive map data. The shape of the road 546 in the detailed map area 543 is generated from the detailed map data while that in the extensive map area 544 is generated from the extensive map data, by which the road 546 is displayed in a shape which is generated from road data of two different map levels. In the case where map elements of two different map levels are combined together and displayed as in the example of the road 546, problems shown in FIG. 15 arise at the area boundary 547.

Figure 15:
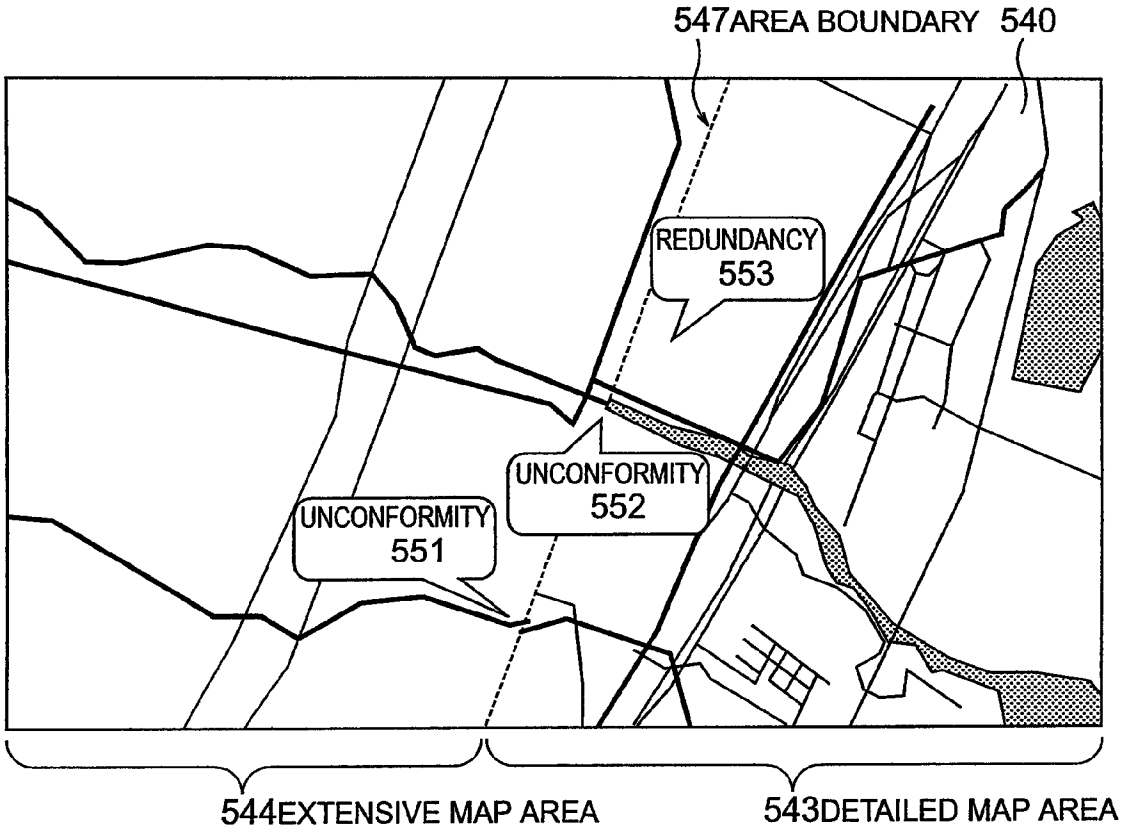
FIG. 15 shows an example of a screen in which two maps of different map levels are combined together and displayed.

FIG. 15 shows an example of a screen 540 in which two maps of different map levels are combined together and displayed. Map elements in extensive maps are more simplified elements compared to those in detailed maps. Therefore, when a map element intersecting with the area boundary 547 is partitioned at the boundary and displayed by the data combining, there occur display irregularities such as unconformity 551 where road data from both sides of the area boundary 547 are not joined together, unconformity 552 where shapes of the joining parts (a detailed map configuration (surface) and an extensive map configuration (line)) do not match each other, etc. Further, the same name can be displayed on the screen redundantly (553) since name data for a map element intersecting with the area boundary line is included in both the detailed map data and the extensive map data. A modification process for preventing such irregularities will be described in more detail referring to FIGS. 16-20.

Figure 16:
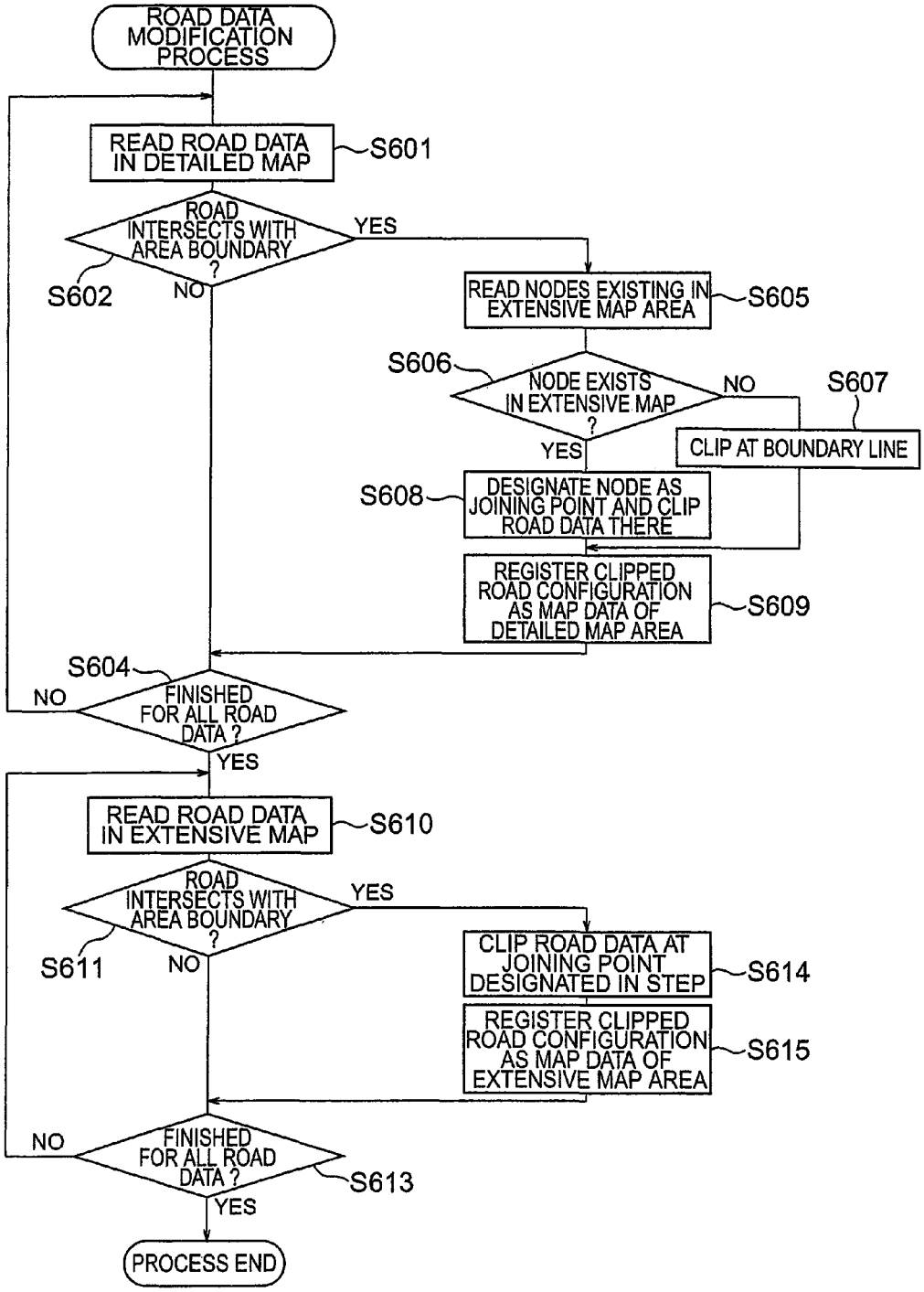
FIG. 16 is a flow chart showing a procedure for modifying road data of map data intersecting with a boundary.

FIG. 16 is a flow chart explaining a modification process for preventing the unconformity where road data are not joined together at the area boundary line. In the road data modification process (S755), the modification is carried out to both the detailed map data and the extensive map data. The road data are represented by node (intersection) coordinates of a plurality of nodes and a link sequence connecting the nodes. First, the modification process is executed to road data of the detailed map. From the route vicinity map cut out in the step S754 shown in FIG. 13, road data of a road (hereinafter referred to as a "detailed road") contained in the detailed map is read out (S601), and whether the detailed road is a road intersecting with the area boundary 547 or not is checked (S602). If the detailed road is a road intersecting with the area boundary 547, data of nodes existing in the extensive map area 544 are read out (S605) and thereby whether the detailed road has an intersection with a road contained in the extensive map (hereinafter referred to as an "extensive road") or not is checked (S606). If the extensive map area 544 contains a node corresponding to such an intersection, the node is designated as a joining point and the road data is clipped at the joining point (S608). On the other hand, if the extensive map area 544 does not contain a node corresponding to such an intersection, the road data is clipped at the area boundary 547 (S607). Thereafter, the road configuration formed by the clipped road data is registered with the route vicinity map as a map element of the detailed map area 543 (S609). The above process is carried out to all the detailed roads existing in the detailed map area 543 (S604), by which a peripheral map of the detailed map area is generated.

Figure 17:
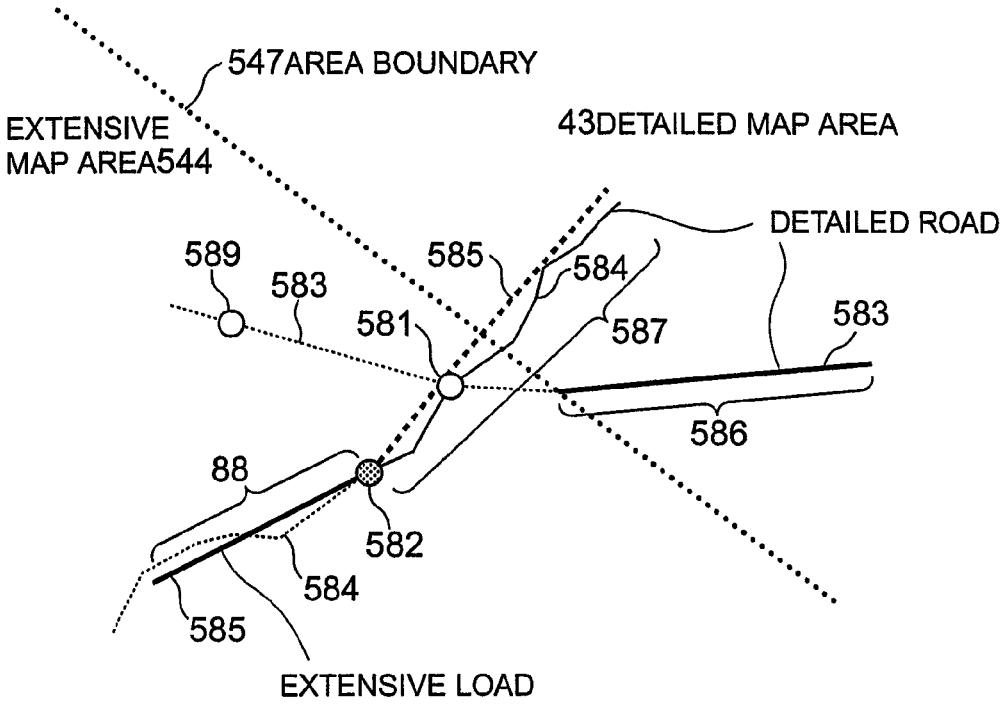
FIG. 17 is a schematic diagram showing a method for modifying road data.

Specifically, as shown in FIG. 17, road data 583 contained in the detailed map intersects with the area boundary 547. Therefore, nodes existing in the extensive map area 544 across the area boundary 547 are read out successively in the step S605, and an intersection with another road contained in the extensive map (extensive road) is searched for in the step S606. In the case of the road data 583, an intersection with an extensive road is searched for in the order of intersections 581, 589, etc. Consequently, no intersection is found and thereby the road configuration is clipped at the area boundary 547 in the step S607, by which a road configuration 586 is generated. Also in the case of a detailed road 584, an intersection with an extensive road is successively searched for in the order of intersections 581, 582, etc. in the step S606. The intersection 582 is an intersection with an extensive road, therefore, the intersection 582 is designated as a joining point between the detailed road and the extensive road and thereby the road 584 is clipped at the joining point in the step S608, by which a road configuration 587 is generated. The road configurations 586 and 587 generated as above are registered with the route vicinity map as map elements existing in the detailed map area 543.

Next, a modification process for modifying road data of the extensive map data regarding roads intersecting with the area boundary 547 is carried out. From the route vicinity map cut out in the step S754 shown in FIG. 13, road data of a road contained in the extensive map (extensive road) is read out (S610), and whether the extensive road is a road intersecting with the area boundary 547 or not is checked (S611). If the extensive road is a road intersecting with the area boundary 547, the road data is clipped at an intersection corresponding to a joining point designated in the aforementioned step S608 (S614). Thereafter, the road configuration formed by the clipped road data is registered with the route vicinity map as a map element of the extensive map area 544 (S615). The above process is carried out to all the extensive roads existing in the extensive map area 544 (S613), by which a peripheral map of the extensive map area is generated.

In the example of FIG. 17, an extensive road 585 intersects with the area boundary 547, therefore, the road configuration is clipped at the joining point designated in the step S608 (intersection 582 in this case) in the step S614 and thereby a road configuration 588 is generated. The road configuration 588 is registered with the route vicinity map as a map element of the extensive map area 544. While a node of a detailed road intersecting with the extensive road is designated as the joining point in this example so that the detailed road data can be joined to the extensive road data, it is desirable that the detailed/extensive road data to which the joining points have already been added be prestored in the map database 510.

The method for modifying the road data and generating the route vicinity map from map data of different map levels having different finenesses has been explained above. Next, the background data modification process (S756) will be explained below.

Figure 18:
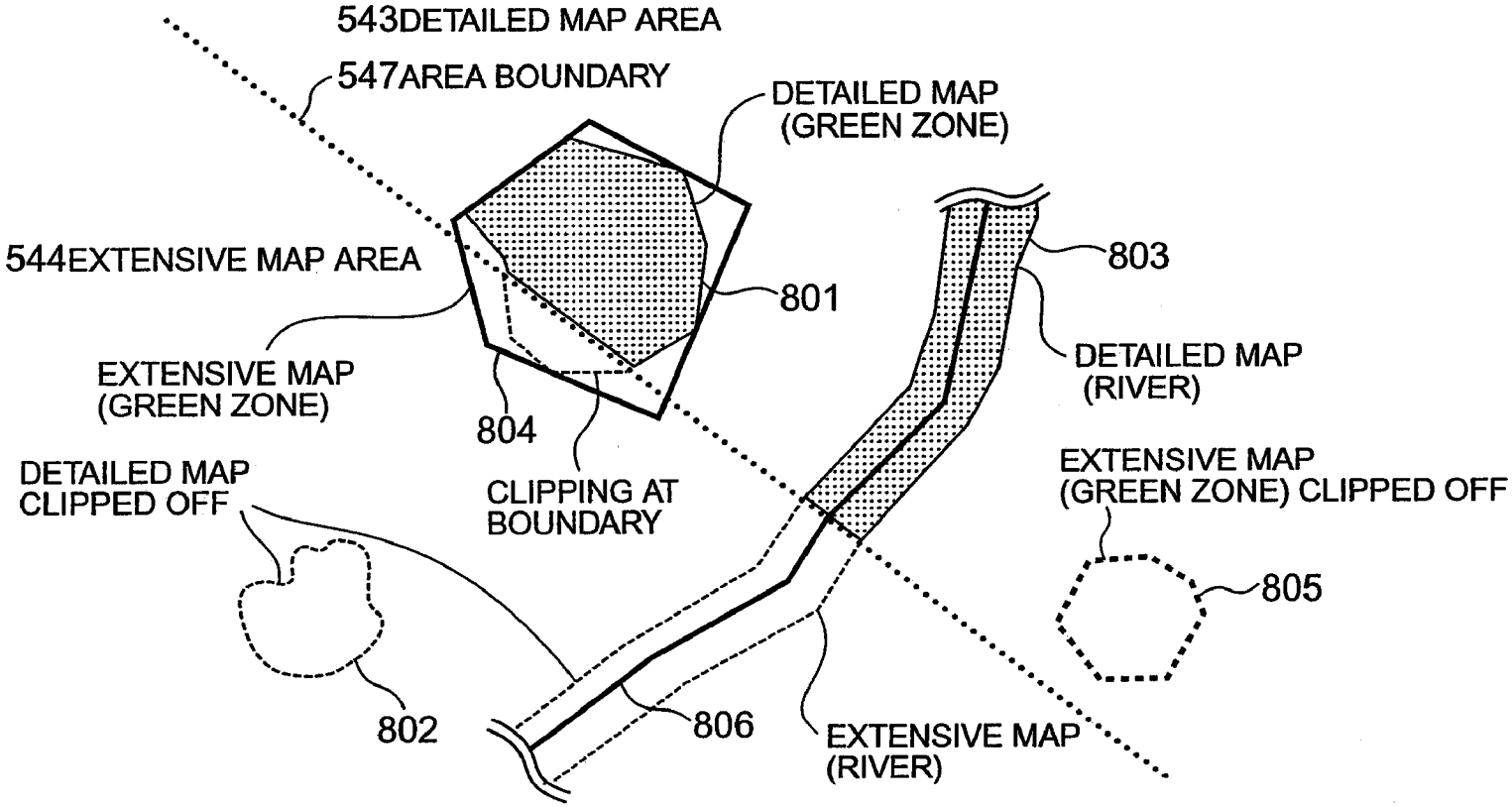
FIG. 18 is a schematic diagram showing a method for modifying background data.
Figure 19:
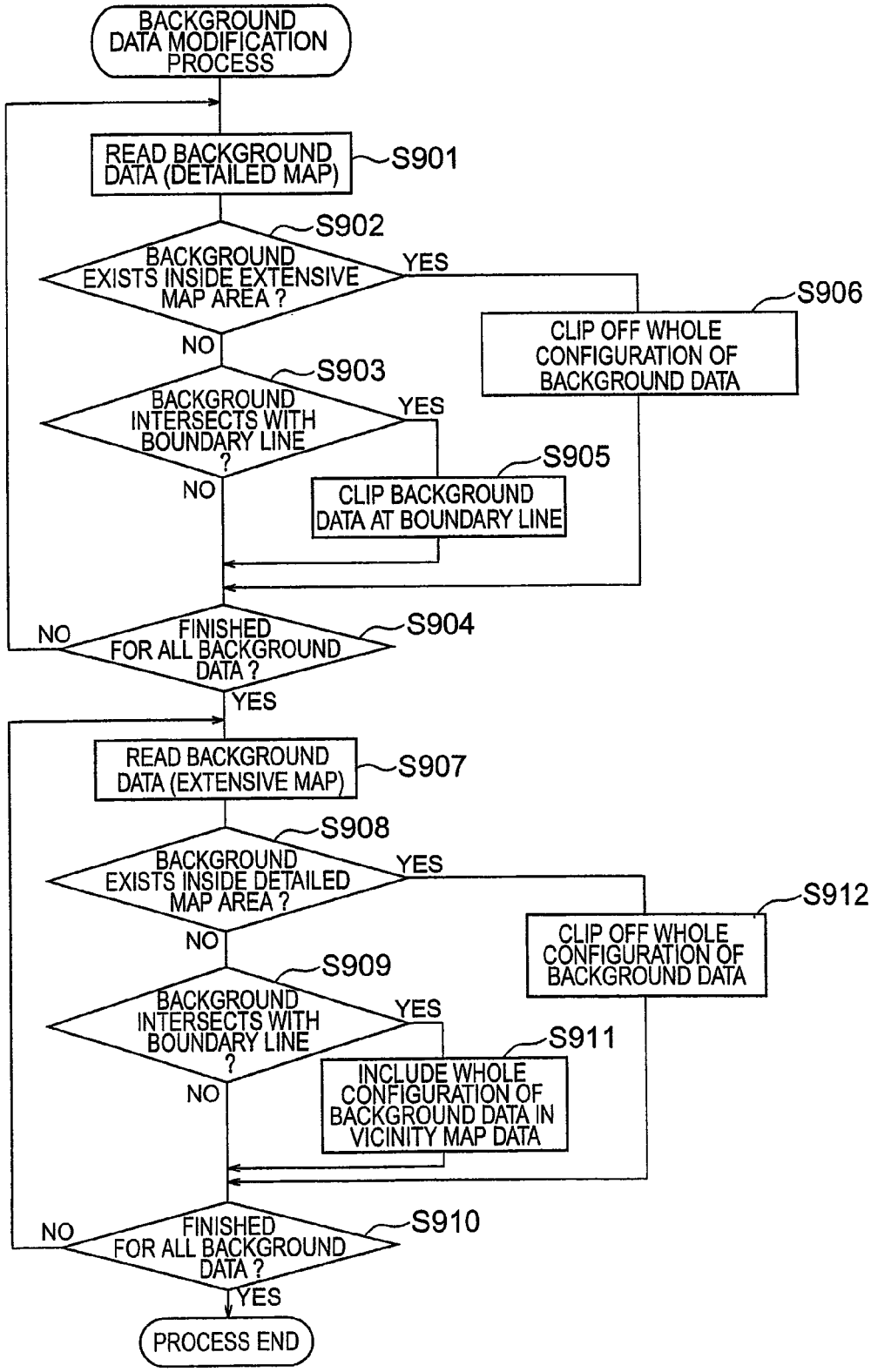
FIG. 19 is a flow chart showing a procedure for modifying background data of map data intersecting with the boundary.

FIG. 19 is a flow chart showing the procedure of the background data modification process. From the route vicinity map, a piece of background data contained in the extensive map (hereinafter referred to as a "detailed background") is read out (S901) and whether the background data exists inside the extensive map area 544 or not is checked (S902). If the background data exists inside the extensive map area 544, the whole configuration of the background data is clipped off (S906). Specifically, as shown in FIG. 18, a detailed background 802 contained in the detailed map data exists inside the extensive map area 544, therefore, all the configuration of the detailed background 802 is cut off in the clipping process of the step S906. If the background data is data existing not only in the extensive map area 544, whether the background data intersects with the area boundary 547 or not is checked (S903). If the detailed background intersects with the area boundary, the configuration of the background is clipped at the area boundary line (S905) and thereby part of the configuration protruding through the area boundary line to the extensive map area 544 is clipped off. Referring to the example of FIG. 21, detailed backgrounds 1101 (green zone) and 1103 (river) are background data intersecting with the area boundary 547, therefore, parts of the backgrounds protruding through the area boundary to the extensive map area 544 are cut off in the clipping process of the step S905.

Subsequently, a piece of background data (hereinafter referred to as an "extensive background") is read out from the extensive map (S907) and whether the background data is an extensive background situated inside the detailed map area 543 or not is checked (S908). If the whole configuration of the extensive background is situated inside the detailed map area 543, the whole background data is clipped off (S912). A green zone 1105 shown in FIG. 11 is an extensive background existing in the detailed map area, therefore, the green zone 1105 as the extensive background is cut off in the step S912. If the whole configuration of the extensive background is not situated inside the detailed map area 543, whether the extensive background intersects with the area boundary 547 or not is checked (S909). If the extensive background intersects with the area boundary, the whole configuration of the background data is registered with the route vicinity map (S911). In other words, the whole configurations of extensive backgrounds intersecting with the area boundary are all registered with the route vicinity map regardless of the areas. Regarding the background data intersecting with the area boundary, the route vicinity map is generated from map data of two or more map levels (detailed & extensive) having different finenesses in the method of the above example. However, the background of the route vicinity map may also be generated from extensive background data or detailed background data only, without setting the area boundary for the background data.

In the redundant data modification process (S757) for preventing the redundant display of name data (553), map elements intersecting with the area boundary 547 are extracted from the route vicinity map and comparison of name data is made between map elements in the detailed map area 543 and map elements in the extensive map area 544. If there is a redundant name (a pair of names), one of the names is deleted, by which the redundant display of name data can be avoided. Besides the above method detecting and deleting redundant names on the server side, the redundant names can also be detected and deleted on the client side. However, the method deleting redundant names on the server side is more advantageous for the reduction of the amount of map data.

A method for generating the route vicinity map by reading map data of two or more map levels of different finenesses (e.g. the detailed map data and the extensive map data) from the map database 510 and modifying the shapes of the map elements has been explained above.

Figure 20:
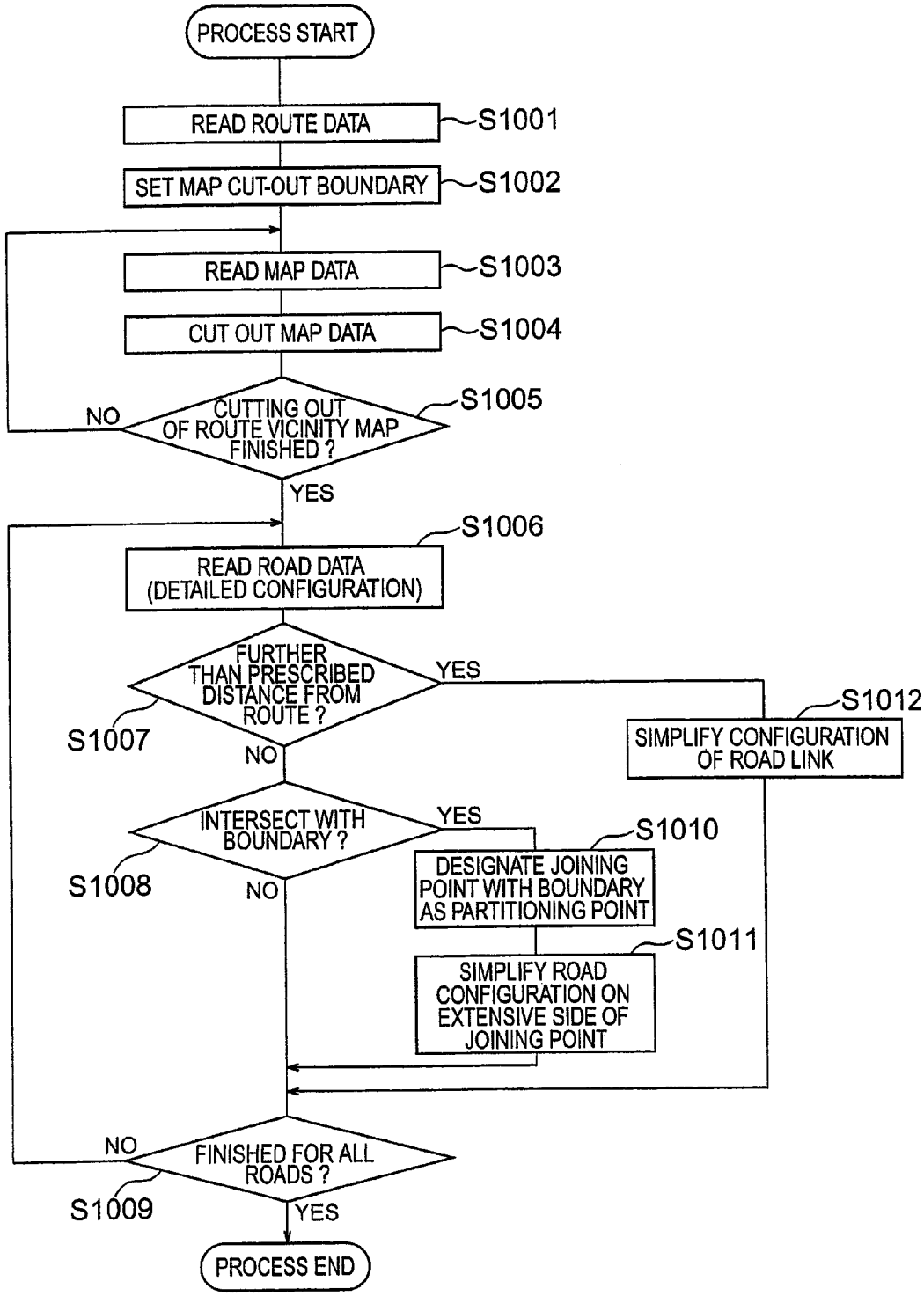
FIG. 20 is a flow chart showing a procedure for simplifying a map element distant from a route.

Besides the above method, the route vicinity map can also be generated from map data of a single map level, by reading out the detailed map data, simplifying the configurations, and modifying configurations of map elements on the area boundary. Such a method will be explained below referring to FIG. 20. FIG. 20 is a flow chart showing a procedure for reading out the detailed map data, simplifying the configurations of map elements distant from the route, and modifying the configurations of map elements intersecting with the area boundary.

Route data of the route 540 from the start point 541 and the end point 542 (outputted by the route search module 512 based on the route ID designated in the step S710) is read out (S1001) and a zonal area for cutting out a map is set based on the route data (S1002). Detailed map data of a set area is read out from the map database 510 (S1003) and map data existing in the area set in the step S1002 is cut out (S1004). These steps are repeated until the cutting out of the route vicinity map (the map of the area set in the step S1002) is finished (S1005). Map element data of the detailed map are read out from the route vicinity map generated as above (S1006), map elements situated further than a prescribed distance from the route 540 are detected (S1007), and the configurations of such map elements are simplified (S1012). In cases where the map element is road data, the configuration of each road link is simplified. A detailed map area and an extensive map area are set depending on the distance from the route and whether each map element intersects with the boundary between the two areas (S1008). If the map element intersects with the area boundary, the configuration of the map element is modified so that irregularity at the area boundary will be avoided. For each map element existing on the area boundary, the joining point of the map element with the area boundary line is designated as a partitioning point for partitioning the configuration of the map element (S1010) and the map element configuration on the extensive map area side of the joining point (partitioning point) is simplified (S1011). The above process is repeated until the modification process is finished for all the map elements (S1009).

The above process will be explained more concretely taking road data as an example (simplification and modification of road configuration). In the case of a road link (a line connecting nodes of the road) situated further than a prescribed distance from the route 540, the configuration of the road link is simplified by thinning out interpolation point data (used for expressing characteristics of the road configuration) in the step S1012. Besides such simplification of each link, thinning out detailed road data (of narrow streets, etc.) based on road attributes (road width, city road, etc.) is also possible. Either way is effective for reducing the amount of map data. On the other hand, in the case of road data within a prescribed distance from the route, that is, road data intersecting with the area boundary between the detailed map and the simple map, a joining point of the road is set by figuring out an intersection point between the road link and the area boundary line in the step S1010. In the step S1011, road data on the route side of the partitioning point is generated in a detailed configuration while road data on the other side of the partitioning point (further from the route) is generated in a simple configuration, and the configuration data of different finenesses are joined together at the joining point. Identification information for identifying each joining point may be delivered together with the route vicinity map. By the addition of the identification information on the joining points, configurations of map elements of different finenesses (levels) can be joined together at the joining point and displayed even when the coordinates of the joining points do not match each other.

As for the background data, both detailed configuration and simple configuration of background data existing on the area boundary are contained in the route vicinity map as explained referring to FIG. 19. In this case, identification information for discriminating between the same backgrounds having different finenesses (levels) may be delivered together with the route vicinity map, by which one of the backgrounds having different finenesses can be selected by use of the identification information and displayed on the client device 502.

Figure 21:
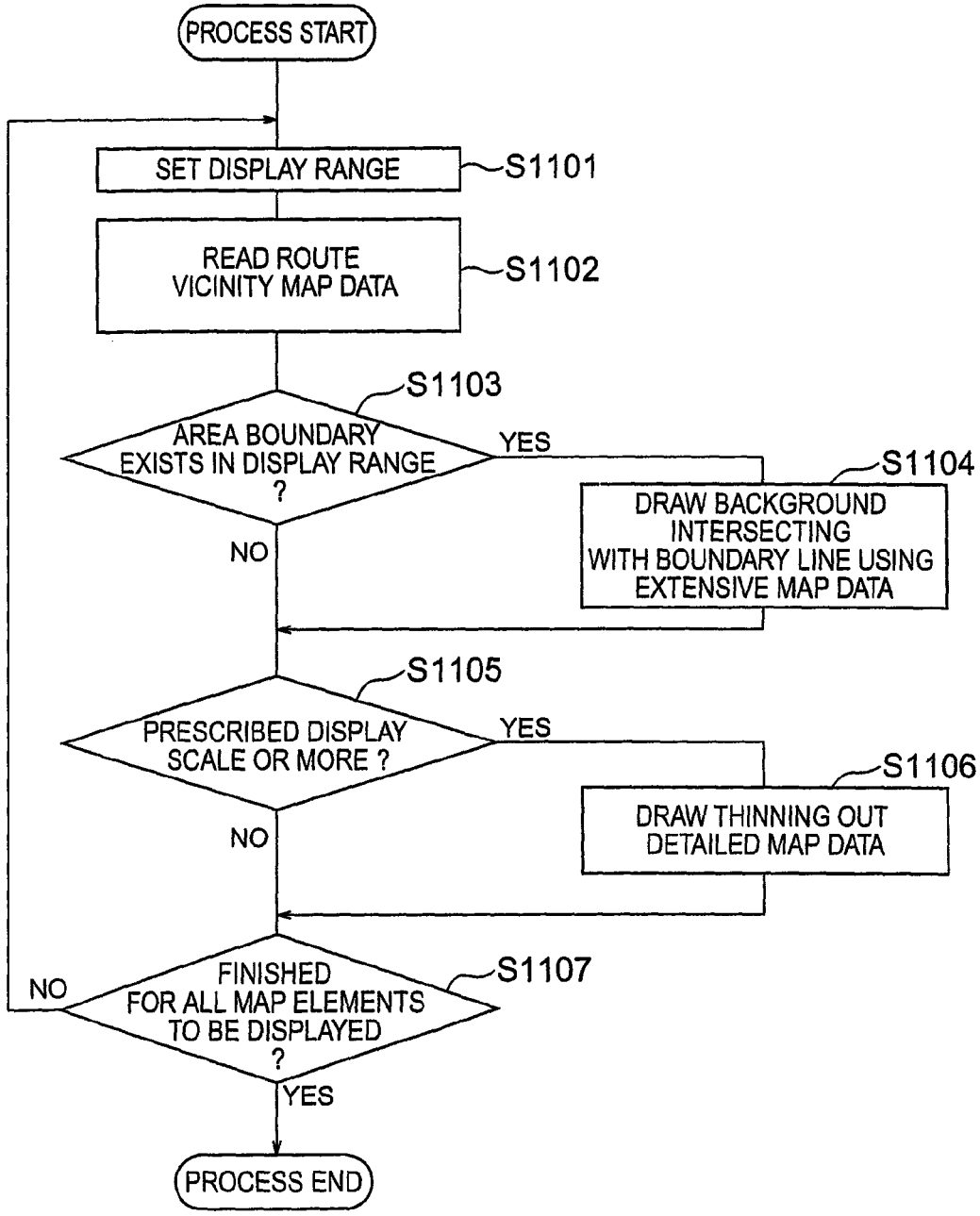
FIG. 21 is a flow chart showing an example of a process executed by a display module.

FIG. 21 is a flow chart showing an example of a process executed by the display module 521 of the client device 502 for displaying the route vicinity map generated by the server device 501.

After a map display range is set (S1101), route vicinity map data received by the communication module 522 is inputted (S1102). The route vicinity map data is assumed to have been stored in an internal memory of the client device 502 or a detachable external storage medium (memory card, etc.). Whether there exists the area boundary 547 in the map display range or not is checked (S1103). If the area boundary exists in the display range, the drawing of background data intersecting with the area boundary line is carried out by use of background data of the extensive map (simple configurations) (S1104). Subsequently, whether or not the scale of the map to be displayed is a prescribed scale or more is checked (S1105). If the display scale is the prescribed scale or more, detailed map data existing in the detailed map area 543 are displayed by thinning out the data so that roads of prescribed types will not be displayed (S1106). The above process is repeated for all map elements to be displayed (S1107), by which roads which have been clipped at the area boundary line (e.g. the road 545) are displayed on the screen without being cut halfway and thereby map display without the feeling of strangeness is made possible.

While the above description has been given regarding the above embodiments, the present invention is not to be restricted by the particular illustrative embodiments. It is to be appreciated that those skilled in the art can change or modify the embodiments in various ways within the spirit of the present invention and the scope the appended claims.

The invention claimed is:

1. A navigation system having a server apparatus with a route search module for searching a route to a destination and a client apparatus including a communication module for communicating with said server, wherein;

said server apparatus comprising:

a map generation module for generating a route periphery map which is a map of a route peripheral vicinity including said route;

a map modification module for modifying said route periphery map generated at said map generation module; and a map data base being referenced while generating said route periphery map;

said client apparatus comprising:

a vehicle position detection apparatus for detecting a position of the vehicle; and a display module for displaying said route periphery map, wherein said map generation module generates said route periphery map by dividing said route periphery map into a plurality of vicinities having different degrees of fineness, said map modification module modifies a shape of at least one map element that intersects a boundary between a first vicinity and a second vicinity having different degrees of fineness, at connecting points provided on said boundary, so that said shape of said map element is continued between said first and second vicinities, if said map element comprises road data, said map modification module divides said road data intersecting with said boundary at a common node in said first and second vicinities located closest to said boundary, and if said map element comprises background data, said map modification module retains all of a first portion of said background data for which a degree of fineness of the map element is simpler than a second portion of said background data.

2. A navigation system according to claim 1, wherein said map modification module detects whether name data of said map elements included in said first and second vicinities are overlapped or not, and displays either one of overlapped names.

3. A server apparatus utilized in navigation system including a route search module for searching a route to a destination in accordance with a request from a navigation terminal apparatus, comprising;

a map generation module for generating route periphery map which is a map of a route peripheral vicinity including said route;

a map modification module for modifying said route periphery map generated at said map generation module; and a map data base being referenced while generating said route periphery map; wherein said map generation module generates said route periphery map by dividing said route periphery map into a plurality of vicinities having different degrees of fineness, said map modification module modifies a shape of at least one map element that intersects a boundary between a first vicinity and a second vicinity having different degrees of fineness, at connecting points provided on said boundary, so that said shape of said map element is continued between said first and second vicinities, if said map element comprises road data, said map modification module divides said road data intersecting with said boundary at a common node in said first and second vicinities located closest to said boundary, and if said map element comprises background data, said map modification module retains all of a first portion of said background data for which a degree of fineness of the map element is simpler than a second portion of said background data.

* * * * *